United States Patent [19]

Akagawa et al.

[11] Patent Number: 4,749,076

[45] Date of Patent: Jun. 7, 1988

[54] BILL ACCEPTANCE CONTROL METHOD

[75] Inventors: Masaki Akagawa, Sakado; Hideaki Onda, Ageo, both of Japan

[73] Assignee: Kabushiki Kaisha Nippon Coinco, Tokyo, Japan

[21] Appl. No.: 834,115

[22] Filed: Feb. 24, 1986

Related U.S. Application Data

[63] Continuation of Ser. No. 570,544, Jan. 13, 1984, abandoned.

[30] Foreign Application Priority Data

Jan. 18, 1983 [JP] Japan ..... 58-5337

[51] Int. Cl.[4] ..... G07F 7/04

[52] U.S. Cl. ..... 194/207; 194/216

[58] Field of Search ..... 194/206, 207, 216, 217, 194/218; 209/534

[56] References Cited

U.S. PATENT DOCUMENTS 3,222,057 12/1965 Couri ..... 194/4 R X 3,870,629 3/1975 Carter et al. ..... 209/534

4,011,931 3/1977 Wyckoff ..... 194/4 C 4,096,991 6/1978 Iguchi ..... 209/534 X 4,487,306 12/1984 Nao et al. ..... 194/4 C 4,513,439 4/1985 Gorgone et al. ..... 194/206 X

*Primary Examiner*—F. J. Bartuska

*Attorney, Agent, or Firm*—Spensley Horn Jubas & Lubitz

[57] ABSTRACT

A bill accepting device judges whether a deposited bill is a true bill or not and produces a true bill signal if it is a true bill. A device such as a vending machine utilizing this bill accepting device receives this true bill signal, counts the number of the deposited bill and, upon confirming that the counting has been properly made, produces a true bill confirmation signal. The bill accepting device receives the true bill confirmation signal and thereby confirms that the true bill signal has been properly used. Thereupon, the bill accepting device stores the deposited bill. If this confirmation has not been made, the deposited bill is automatically returned notwithstanding that it is a true bill.

4 Claims, 33 Drawing Sheets

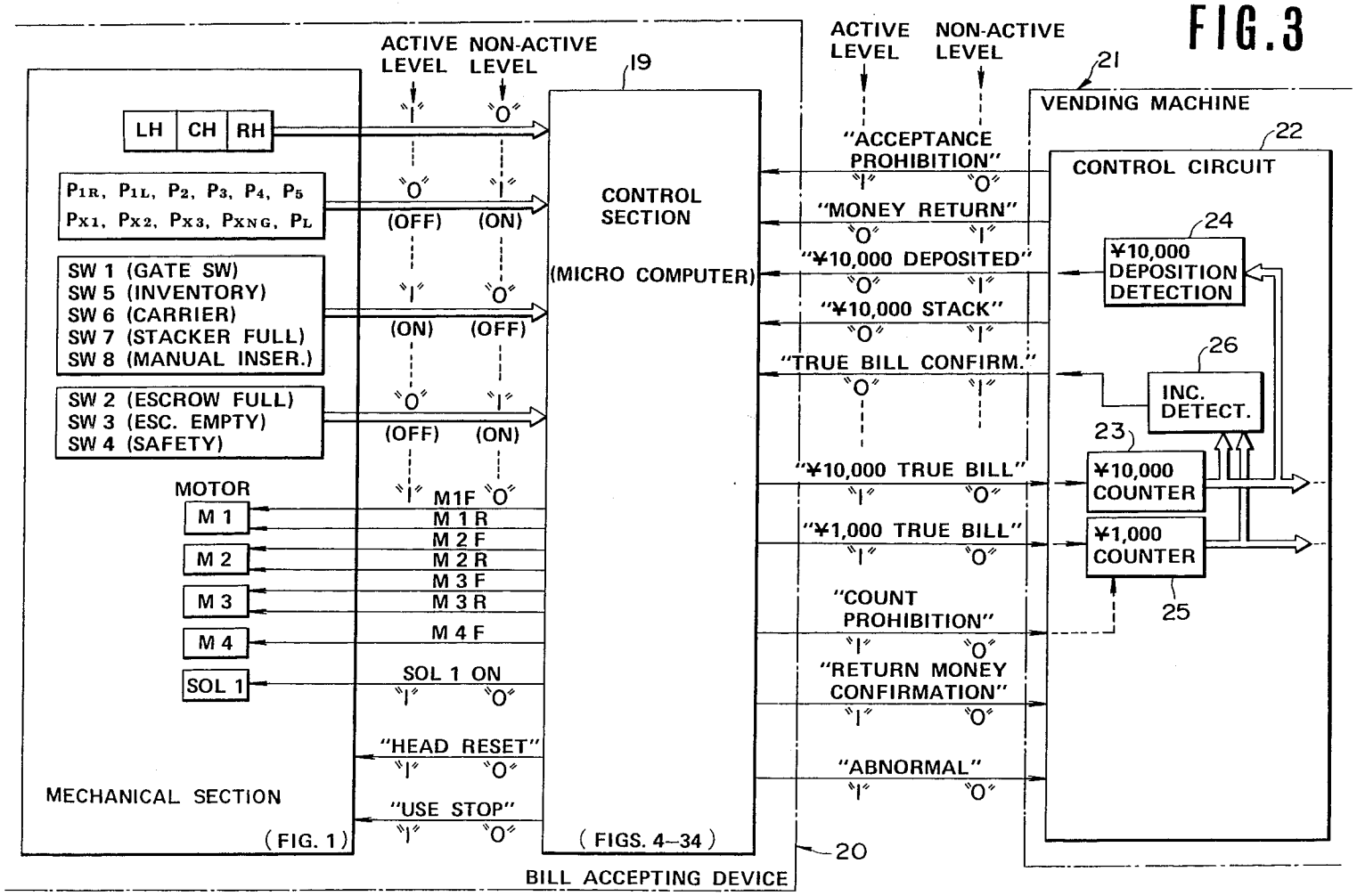
FIG. 3
VENDING MACHINE
21
CONTROL CIRCUIT
22
¥10,000 DEPOSITION DETECTION
24
INC. DETECT.
26
¥10,000 COUNTER
23
¥1,000 COUNTER
25
ACTIVE LEVEL
NON-ACTIVE LEVEL
"ACCEPTANCE PROHIBITION"
"MONEY RETURN"
"¥10,000 DEPOSITED"
"¥10,000 STACK"
"TRUE BILL CONFIRM."
"¥10,000 TRUE BILL"
"¥1,000 TRUE BILL"
"COUNT PROHIBITION"
"RETURN MONEY CONFIRMATION"
"ABNORMAL"
20
BILL ACCEPTING DEVICE
19
CONTROL SECTION
(MICRO COMPUTER)
(FIGS. 4–34)
(OFF)
(ON)
M1F
M1R
M2F
M2R
M3F
M3R
M4F
SOL 1 ON
"HEAD RESET"
"USE STOP"
LH
CH
RH
$P_{1R}$, $P_{1L}$, $P_2$, $P_3$, $P_4$, $P_5$
$P_{X1}$, $P_{X2}$, $P_{X3}$, $P_{XNG}$, $P_L$
SW 1 (GATE SW)
SW 5 (INVENTORY)
SW 6 (CARRIER)
SW 7 (STACKER FULL)
SW 8 (MANUAL INSER.)
SW 2 (ESCROW FULL)
SW 3 (ESC. EMPTY)
SW 4 (SAFETY)
MOTOR
M 1
M 2
M 3
M 4
SOL 1
MECHANICAL SECTION
(FIG. 1)

FIG.14
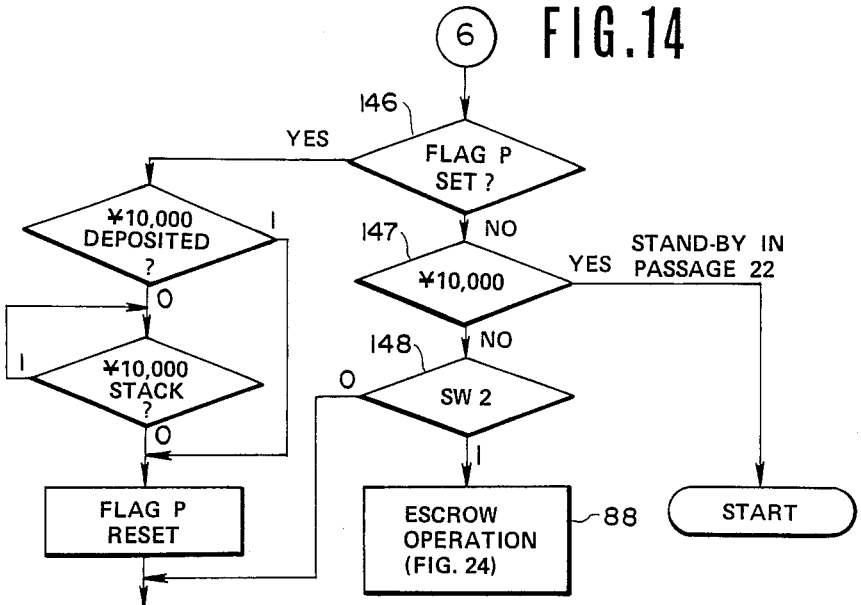
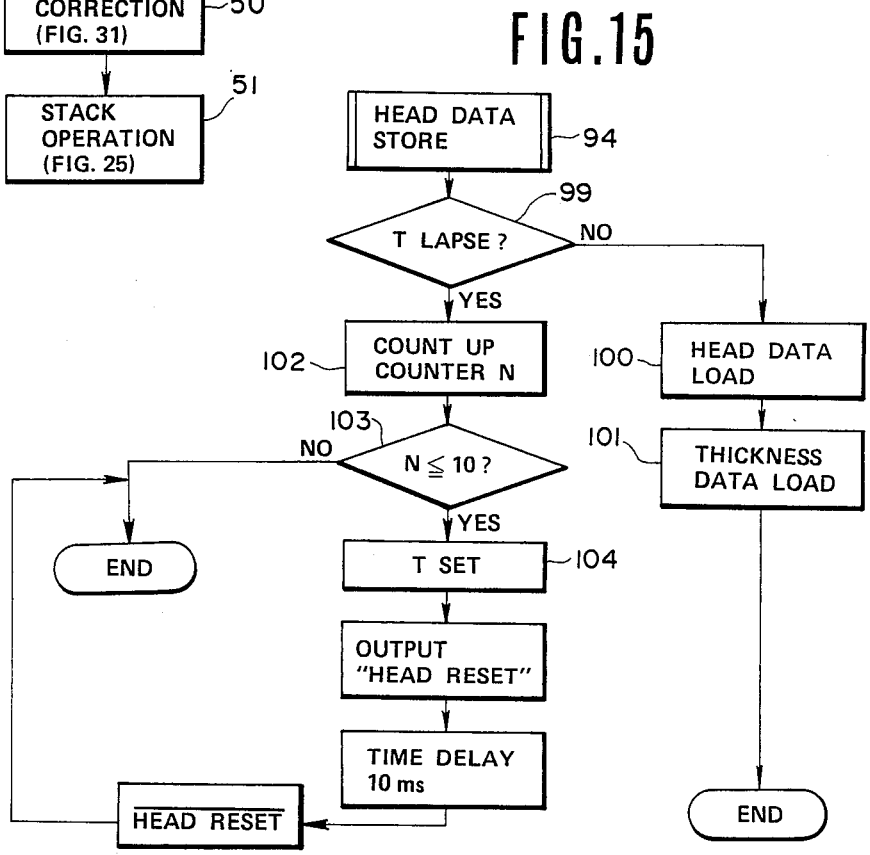
FIG.15

10
182
P4
0
1
NO
t2 LAPSE ?
YES
JAM 6
179
TIME DELAY 300ms
STOP M2
183
53
¥10,000 RETURN
5 sec.
t4 SET
166
M3R
167
P5
1
NOT DETECTED
t4 LAPSE ?
NO
YES
JAM 7
169
0
168
NOT DETECTED
1
P3
NO
t4 LAPSE ?
YES
JAM 7
169
0
M1R
170
P2
1
t4 LAPSE ?
NO
YES
JAM 7
169
0
171
SOL 1 ON
11

RETURN SUBROUTINE
74

STOP M1
TIME DELAY 300ms
5 sec.
t4 SET
OUTPUT M1R
P2
0
1
t4 LAPSE ?
NO
YES
JAM 1
TIME DELAY 300ms
SOL 1 OFF
PX2
0
1
NO
t4 LAPSE ?
YES
JAM 1
PL
0
1
t4 LAPSE ?
NO
YES
JAM 1
TIME DELAY 300ms
STOP M1
76
TEST 4
NO
YES
START

BILL ACCEPTANCE CONTROL METHOD

This is a continuation of application Ser. No. 570,544, filed Jan. 13, 1984, now abandoned.

BACKGROUND OF THE INVENTION

This invention relates to a bill acceptance control method and a bill accepting system used in a vending machine or exchanger.

A bill accepting device generally comprises a bill discrimination device which discriminates a true bill from a counterfeit one among deposited bills and accepts the true bill and returns the counterfeit one. In a prior art bill acceptance control, if a deposited bill has been found to be a true bill, the bill accepting device enters a mode in which this bill is immediately accepted. A true bill signal thereupon is supplied to a vending machine or exchanger which uses this bill accepting device for causing the machine to count the number or amount of deposited bills. In this prior art device, however, in a case where, due to mulfunction in a machine utilizing the bill accepting device such as a vending machine or exchanger or mulfunction in a transmission path of a true bill signal, the counting operation is not performed in the machine utilizing the bill accepting device despite the fact that a true bill signal has been generated by the bill accepting device, the deposited bill is received and not returned by the bill accepting device without dispensing of any article or exchanging of money. This inconvenience occurs because the prior art device takes in the bill without confirming whether the true bill signal has been properly used for its purpose or not.

SUMMARY OF THE INVENTION

It is an object of the invention to eliminate the above described disadvantage of the prior art device by providing a bill acceptance control method and a bill accepting system according to which a deposited bill is finally stored in the bill accepting device only after the true bill signal has been properly used in the machine utilizing the bill accepting device (e.g. the counting operation).

According to the bill acceptance control method of the invention, when a predetermined counting operation has been performed in response to a true bill signal (i.e., a signal representing that the deposited bill is a true bill) provided by a bill accepting device, a signal representing the performance of the counting operation is fed back to the bill accepting device as a true bill confirmation signal and, if this bill confirmation signal has not been supplied to the bill accepting device within a predetermined period of time, the deposited bill is returned by the bill accepting device despite that this bill is a true bill.

This method enables the bill accepting device to store a true bill only after confirming that the counting of the bill has been properly made while automatically returning a deposited bill if such counting has not been confirmed. An accurate bill acceptance control without errors thereby can be realized and the trouble of storing a bill without rendering any service can be effectively prevented.

The bill accepting system according to the invention comprises a bill accepting device and a utilizing device. The bill accepting device comprises discrimination means for judging whether a deposited bill is a true bill or not to deliver out a true bill signal when the deposited bill has been judged to be true, checking means receiving a true bill utilization confirmation signal supplied from outside for checking whether the true bill confirmation signal has been supplied within a predetermined period of time from the time when the true bill signal has been delivered out by the discrimination means, bill storing means for taking in and storing the deposited bill if the checking means has confirmed that the true bill confirmation signal has been supplied within the predetermined period of time, and returning means for returning the deposited bill if the checking means has not confirmed that the true bill confirmation signal has been supplied within the predetermined period of time. The device utilizing said bill accepting device comprises counting means for receiving the true bill signal and using it for counting of the deposited bill and supplying means for supplying, upon confirming that the counting operation has been performed in response to the true bill signal, the true bill confirmation signal to the bill accepting device.

BRIEF DESCRIPTION OF THE DRAWINGS

In the accompanying drawings,

FIG. 3 is a schematic block diagram showing input and output relationship between a control section of the bill accepting device associated with the mechanical section in FIG. 1 and a control circuit of a vending machine associated with this control section;

FIGS. 4 through 34 are flow charts showing specific examples of microcomputer programs executed by the control section shown in FIG. 3 in which:

FIG. 4 is a flow chart schematically showing its main routine;

FIG. 5 is a flow chart showing a sensor check program in FIG. 4;

FIG. 6 is a flow chart showing a switch check program in FIG. 4;

FIGS. 7(*a*) and 7(*b*) are flow charts showing a signal check program in FIG. 4;

FIG. 8 is a flow chart showing a flag check program in FIG. 4;

FIGS. 9(*a*) to 9(*c*) are flow charts showing a bill receiving program in FIG. 4;

FIGS. 10 to 17 are flow charts showing a discrimination operation program in FIG. 4;

FIGS. 18 to 23 are flow charts showing subroutines for checking states of bill detecting photosensors;

FIG. 24 is a flow chart showing an escrow operation subroutine;

FIG. 25 is a flow chart showing a stack operation subroutine;

FIGS. 26(*a*) to 26(*e*) are flow charts showing a subroutine for returning a 1,000-yen bill and a 10,000-yen bill;

FIG. 27 is a flow chart showing a return subroutine;

FIGS. 28(*a*) and 28(*b*) are flow charts showing an inventory subroutine;

FIGS. 29 and 30 are flow charts showing a program when power is ON;

FIG. 31 is a flow chart showing a position correction subroutine;

FIG. 32 is a flow chart showing a successive deposition check subroutine; and

FIGS. 33 and 34 are flow charts showing subroutines for stopping a bill carrying motor in an abnormal state.

DESCRIPTION OF A PREFERRED EMBODIMENT

Figure 1:
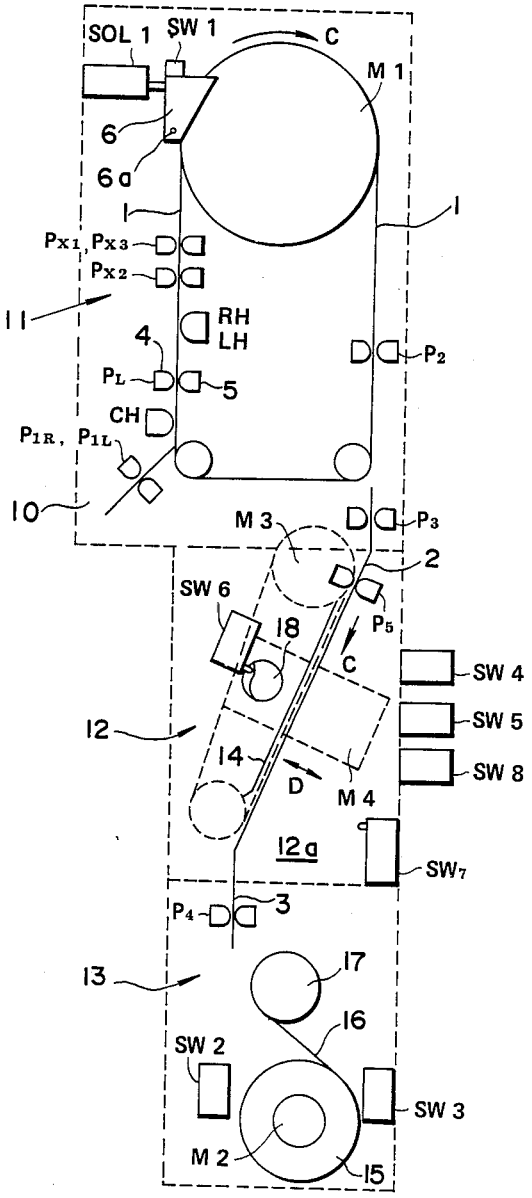
FIG. 1 is a schematic side view of a mechanical section of a bill accepting device used in an embodiment of the invention.

FIG. 1 is a schematic side elevation of a mechanical section of a bill accepting device used in an embodiment of this invention. The bill accepting device has a bill discrimination section 11 for discriminating a true bill from a counterfeit one among bills inserted from a bill insertion slit 10, an escrow section 13 for temporarily retaining the bill which has been judged to be true in a state in which the bill can be automatically returned and a stacker section 12 provided between the bill discrimination section 11 and the escrow section 13 for storing a bill which has been once received in a state in which it cannot be automatically returned. A bill passage 1 in the bill discrimination section 11, a bill passage 2 in the stacker section 12 and a bill passage 3 in the escrow section 13 are connected together in a single passage. The bill passage is adapted so that a bill can be temporarily retained in the straight passage 2 in the stacker section 12.

An outline of the manner of the bill accepting control according to the invention will first be described together with an outline of the construction shown in FIG. 1.

A bill which has been inserted with its side edge first into the insertion slit 10 is pulled into the bill passage 1 of the bill discrimination section 11 by a forward rotation of a motor M1 and conveyed through the passage 1 in the direction of arrow C. The judgement as to whether the deposited bill is true or not is made in the course in which the bill is conveyed through the passage 1 on the basis of outputs of various sensors provided in the passage 1. If even a single condition of a true bill is not satisfied, the bill is instantly returned by reversely rotating the motor M1. Otherwise, the forward rotation of the motor M1 is maintained and when the rear end of the bill has passed a gate switch SW1, the bill is finally judged to be a true bill. When the judgement that the inserted bill is a true bill has been made, a true bill signal is delivered to a utilizing device to cause the utilizing device to count the number or amount of the deposited bill. The utilizing device, upon conducting this counting, delivers a true bill confirmation signal to the bill accepting device.

In the meanwhile, the bill in the bill accepting device passes through a bill sensor P3 provided at the exit of the bill discrimination device 11 and enters the passage 2 of the stacker section 12 by the continuous forward rotation of the motor M1. The stacker section 12 conveys, by a forward rotation of a conveying motor M3, the bill in the passage 2 toward the accepting direction (the direction of arrow C). When the bill has arrived at a position opposing a push plate 14, the motor M3 is stopped and bill is held in that position (i.e., in the passage 2). By this time, whether or not the true bill confirmation signal has been given within a predetermined time after the delivery of the true bill signal is confirmed and, if the true bill confirmation signal has not been given, the bill accepting device is changed to a bill return mode. That is, the motor M3 is reversely rotated and the deposited bill (true bill) which has been held in the passage 2 is fed back toward the discrimination section 11. As the fed back bill enters the passage 1 in the bill discrimination section 11, the motor M1 is reversely rotated to return the bill to the insertion slit 10. Thus, if no count of the deposited bill has been made, the bill is automatically returned notwithstanding that it is a true bill so that occurrence of inconvenience can be prevented. If true bill confirmation signal has been given in a normal manner, the automatic returning of the bill is not made but the bill is received in a predetermined manner.

Various manners for receiving the accepted bill are conceived. For example, a bill of a predetermined small denomination bill (e.g. 1,000-yen bill) is received in the escrow section 13 and a bill of other denomination (e.g. 10,000-yen bill) is received in a bill storing space 12*a* of the stacker section 12. In this case, if the deposited bill has been judged to be a 1,000-yen bill, the forward rotation of the motor M3 is resumed and the bill having been stopped in the passage 2 is further conveyed in the direction of arrow C and introduced into the passage 3 in the escrow section 13. The escrow section 13 includes a drum 15 rotated by a motor M2 and a belt-like spring 16 which is fixed at one end thereof to the periphery of the drum 15 and at the other end thereof to a winding core 17. The spring 16 is biased so that it will be wound on the winding core 17. When the bill has been introduced in the passage 3, the motor M2 is forwardly rotated in the clockwise direction as viewed in the figure and the bill is thereby held between the winding body formed about the drum 15 and the spring 16 and tightly wound about the drum 15 with the spring 16. In the escrow section 13, it is also possible to pay out bills wound about the drum 15 one by one from the passage 3 toward the passage 2 by a reverse rotation of the motor M2. Accordingly, bills received in the escrow section 13 can be returned automatically later.

In a case where the bill stopped in a location opposing the push plate 14 in the passage 2 in the stacker section 12 is received in the bill storing space 12*a*, a motor M4 is rotated to reciprocate the push plate 14 in directions normally crossing the passage 2 (arrow D). In the wall opposing the push plate 14 in the passage 2, there is formed an opening permitting entering of the push plate 14 and the push plate 14 passes through this opening in the wall in its reciprocating movement to push the bill toward the bill storing space 12*a* and cause the bill to be stored therein. The bill which has once been received in the bill storing space 12*a* cannot be automatically returned toward the insertion slit 10 but can be manually taken out in collecting bills by opening a wall lid (not shown) of the bill storing space 12*a*.

An embodiment employing the bill accepting device of FIG. 1 will now be described in detail.

Figure 2:
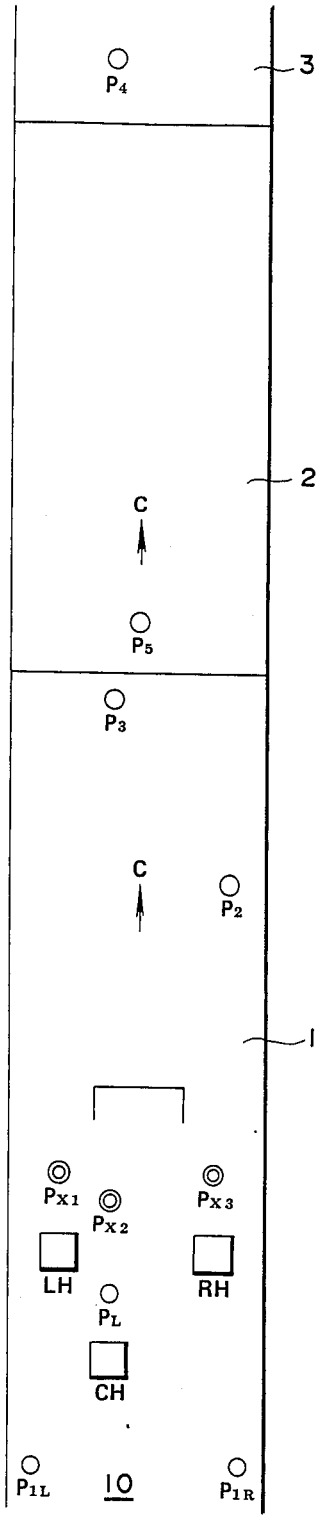
FIG. 2 is a view showing the bill passage in FIG. 1 in an unfolded state in its front, particularly the arrangement of sensors.

FIG. 2 exhibits the bill passages 1, 2, and 3 in their front and unfolded state, particularly locations of various sensors. Reference characters P1L, P1R, PL, RX1, PX2, PX3, P2, P3, P4 and P5 designate photosensors and CH, LH and RH magnetism detection heads. As will be seen from the side elevation of FIG. 1, a pair of photosensors include a light-emitter 4 and a light-receiver 5 provided on both sides of the bill passage (the reference numerals 4 and 5 are affixed by way of example to the photosensor PL). The photosensors P1L–P5 are ON when they are in a stand-by state (i.e. normal state) and OFF when a bill passes by. The magnetic detection heads are OFF when they are in a stand-by state and are turned ON by change of magnetism caused by the passage of a bill.

The two pairs of photosensors P1L and P1R which are provided in the vicinity of the insertion slit 10 with an interval corresponding to the side width of the bill and in the same location in the direction of feeding the bill serve to judge the side width of the bill. The two pairs of photosensors PL and PX2 which are provided at locations slightly offset from the center of the passage 1 with a predetermined interval in the direction of feeding the bill serve to judge the length of the bill in the longitudinal direction. This photosensor PX2 and the photosensors PX1 and PX3 which are spaced from this photosensor PX2 by a predetermined distance in the direction of feeding the bill and also from each other by a predetermined distance in the transverse direction of the bill passage serve to judge the amount of light transmitting through the bill. The magnetism detection head CH which is provided at a location slightly offset from the center of the passage 1 and the magnetism detection heads LH and RH which are spaced from this magnetism detection head CH by a predetermined distance in the direction of feeding the bill and also from each other by a predetermined distance in the transverse direction of the bill passage serve to judge magnetic substance (e.g. iron) contained in the printing ink of the bill. Thus, the side width, longitudinal length, light transmitting property and magnetic substance distribution are examined by these sensors and the deposited bill is accepted if all results of the examination satisfy the conditions of a true bill. If any of the conditions of a true bill has not been satisfied, the bill in the passage 1 is returned to the insertion slit 10 by the reverse rotation of the motor M1. The sensors PL, PX2 and CH are disposed at the locations slightly offset from the center of the passage because a bill often has a folding line in the center thereof and besides the portion of the bill including the folding line often is thinner than the rest of the bill so that it is preferable to conduct the examination in the portion of the bill other than the portion including the folding line.

A gate lever 6 provided in a posterior stage to these bill examining sensors effects control as to whether the bill which has been accepted as a true bill should be returned or not. The lever 6 is normally projecting in the passage 1 as shown in FIG. 1 by means of a weak spring (not shown). As the lever 6 is pushed by a bill advancing in the direction of arrow C (forward direction), the lever 6 is rotated about its pivot 6a out of the passage thereby permitting the bill to pass in the direction of arrow C (accepting direction). If a bill which has once passed by the gate lever 6 is fed back, the lever 6 is locked to block the passage of the bill. In a case where a bill is returned in a normal manner, however, the lever 6 is withdrawn by exciting of a solenoid SOL1 to permit the bill to be fed back in the opposite direction to the arrow C. A gate switch SW1 is OFF when the lever 6 is projecting in the passage 1 and ON when the bill passes or when the lever 6 is out of the passage 1 by the attraction of the solenoid SOL1.

If the passage 1 is divided functionally, it consists of a passage section before the lever 6 in which the bill is examined and a passage section after the lever 6 in which the bill which has been judged to be a true bill is accepted. The length of the latter passage section, i.e., the length from a point immediately after the lever 6 to the termination of the passage 1, is equivalent, for example, to the length of the bill. The sensor P3 provided in the exit of the passage 1, the sensor P5 provided in the entrance of the passage 2 of the stacker section 12, the sensor P4 provided in the entrance of the passage 3 of the escrow section 13 and the sensor P2 provided before the sensor P3 in the passage 1 are used for controlling the motors M1, M2 and M3 in accordance with the position of the bill.

An escrow full switch SW2 is OFF when the storage capacity of the escrow section 13 is full and otherwise is ON. An escrow empty switch SW3 is OFF when the storage of bills in the escrow section is zero and otherwise is ON.

A safety switch SW4 becomes OFF when bills are collected from the bill storing space 12a of the stacker section 12 and normally is ON. An inventory switch SW5 becomes ON when bills stored in the escrow section 13 are transferred one by one to the bill storing space 12a of the stacker section 12 and normally is OFF. A carrier switch SW6 which is a carrier switch for the bill storing motor M4 of the stacker section 12 is normally OFF and is turned ON by a cam 18 within a predetermined rotation angle when the motor M4 has started its rotation thereby ensuring one rotation of the motor M4. A stacker full switch SW7 is ON when the bill storing space 12a of the stacker section 12 is full and otherwise is OFF. A manual insertion switch SW8 is ON when 1,000-yen bills are manually supplemented to the escrow section 13 and otherwise is OFF.

FIG. 3 shows a bill accepting device control section 19 associated with the bill accepting device. The entire bill accepting device which is designated by a reference numeral 20 is incorporated in a vending machine or exchanger 21. The control section 19 performs various electrical controls including judgement as to whether the deposited bill is a true bill or not, a bill accepting control and a bill return control. The control section 19 is composed, e.g., of a microcomputer. To this control section 19 are applied output signals of the above described photosensors P1R–P5, magnetism detection heads CH–RH and switches SW1–SW8. Although not shown in FIG. 1, a photosensor PXNG for detecting thickness of the deposited bill is provided in the former half of the passage 1. This sensor PXNG is normally ON and is turned OFF when the passing bill is thicker than a true bill, indicating that the bill should be returned. The output signal from the photosensor PXNG and an "acceptance prohibition" signal, a "return" signal, a "true bill confirmation" signal, a "10,000-yen deposited" signal and a "10,000-yen stack" signal from a control circuit 22 of the vending machine 21 are applied to the control section 19.

The "acceptance prohibition" signal is "1" when a bill is not in an accepted state and otherwise is "0". If, for example, a final disposition (i.e. whether the bill is to be accepted or returned) of a 1,000-yen or 10,000-yen bill which has been received as a true bill in the escrow section 13 or the passage 2 of the stacker section 12 has not been made yet, the "acceptance prohibition" signal "1" is produced.

The "money return" signal is a signal commanding return of a deposited bill which has once been accepted as a true bill. The money return signal is normally "1" and "0" when the deposited bill is to be returned. When this money return signal is "0", one bill is returned. The control section returns a 10,000-yen bill if the "10,000-yen bill deposited" signal is being produced at this time and otherwise returns a 1,000-yen bill. In this embodiment, denominations of the bills which can be handled by the bill accepting device 20 are 10,000-yen and 1,000-yen. It will be noted, however, that any denominations can be handled by the bill accepting device 20.

The "10,000-yen deposited" signal represents that a 10,000-yen bill has been counted as a deposited bill by the control circuit 22 of the vending machine 21 and is provided by a 10,000-yen deposition detection circuit 24 in response to contents of a 10,000-yen counter 23. When deposition of a 10,000-yen bill has been confirmed from contents of the counter 23, the "10,000-yen deposited" signal is turned to "0" and otherwise is "1".

The "10,000-yen stack" signal is a signal commanding that a 10,000-yen bill which has been temporarily retained in the passage 2 of the stacker section 12 is to be stored in the storing space 12*a* and is "0" when the bill is to be stored and otherwise is "1". This signal is generated when the deposited bill suspended in the passage 2 need not be returned any longer, i.e., conditions for storing a 10,000-yen bill has been satisfied, e.g., vending using a 10,000-yen bill has been made.

The "true bill confirmation" signal is generated when counting of a deposited bill has been made by the 10,000-yen counter 23 or a 1,000-yen counter 25 in response to a "10,000-yen true bill" signal or a "1,000-yen true bill" signal. This signal is generated, e.g., upon detection by an increase detection circuit 26 of increase in the count value in the counter 23 or 25 and is "0" when an increasing count is confirmed and otherwise is "1". This "true bill confirmation" signal thus confirms e.g. that the counter 23 or 25 has properly credited the deposited bill.

Description will now be made about output signals of the control section 19. The "10,000-yen true bill" signal is generated when the deposited bill has been judged to be a 10,000-yen true bill whereas the "1,000-yen true bill" signal is generated when the deposited bill has been judged to be a 1,000-yen true bill. These signals are "1" when the deposited bills are true bills and otherwise are "0". As will be described later, in the control section 19, the true bill signal falls to "0" 50 ms after falling of the "true bill confirmation" signal on the condition that the true bill confirmation signal has been produced (i.e., it has fallen to "0") after generation of the true bill signal (i.e., "10,000-yen true bill" or "1,000-yen true bill" has risen to "1"). If no "true bill confirmation" signal has been generated by the lapse of 200 ms after the generation of the true bill signal, the true bill signal is caused to fall to "0" 300 ms later therefrom and the deposited bill is automatically returned.

M1F–M4F are signals commanding forward rotation of the respective motors M1–M4 of the bill accepting device and M1R–M3R those commanding a reverse rotation of the motors M1–M3. A signal SOL1ON is turned to "1" when the solenoid SOL 1 is energized.

A "head reset" signal is a signal for resetting the magnetism detection heads CH–RH and is turned to "1" at a predetermined interval from the time when the discrimination of bills has been started.

A "use stop" signal is "1" when the bill accepting device is not usable due to disorder or other reason whereby the bill accepting device enters a use-stop mode and simultaneously an indication of use-stop is made on the outside of the vending machine.

A "count prohibition" signal is turned to "1" during the manual insertion of 1,000-yen bills for change and the inventory operation for transferring a 1,000-yen bill from the escrow section 13 to the stacker section 12 thereby prohibiting the counting operations of the counters 23 and 25.

A "return money confirmation" signal is turned to "1" when one of the predetermined denomination bill is automatically returned in response to a "money return" signal provided by the control circuit 22. This signal is supplied to the control circuit 22 to cause, e.g., the counters 23 and 25 to conduct subtraction of the returned bill. Incidentally, the counters 23 and 25 also conduct subtraction corresponding to the vend price when vending has been.

An "abnormal" signal is turned to "1" when disorder or malfunction has taken place somewhere in the bill accepting device or during the inventory operation and thereby clears an empty counter in the control circuit 22 (a counter for counting the number of 1,000-yen bills stored in the escrow section 13).

In FIG. 3, levels in active states and non-active states of the respective signals are described along input and output lines of the control section 19. The "active" state means a state in which the above described detection operation is performed or in which the objective operation is commanded.

An example of a program executed by the control section 19 is illustrated in FIGS. 4 through 34.

Figure 4:
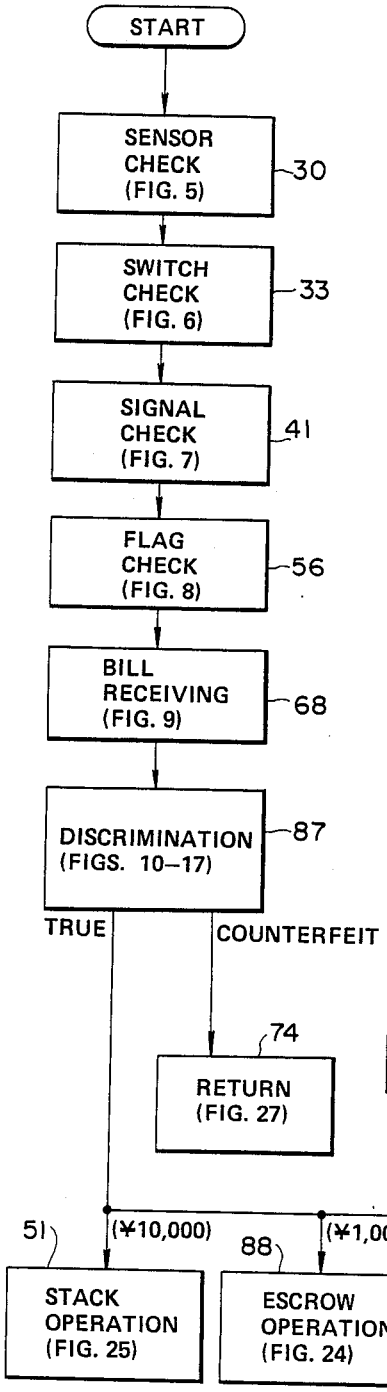
Figure 5:
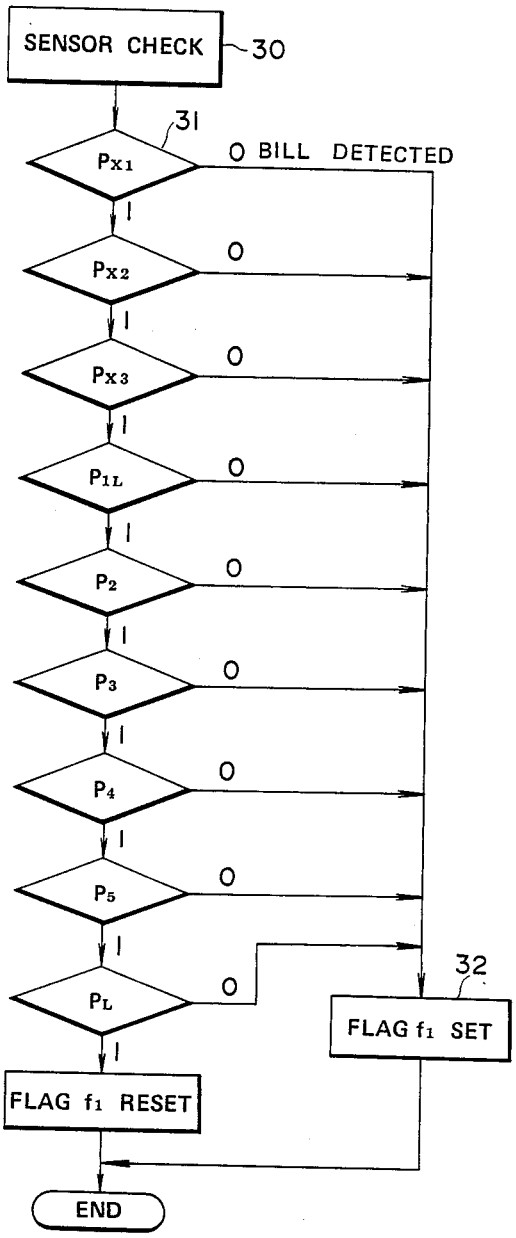

FIG. 4 shows an outline of a main routine of processings executed by the control section 19. A sensor check program 30 is executed at a START (start) point for checking the ON-OFF states of the respective photosensors PX1–PL. Details of the sensor check program are illustrated in FIG. 5. In FIG. 5, characters in diamond-shaped judgement blocks denote the respective photosensors PX1–PL. The program step proceeds to either of flow lines "1" and "0" depending upon whether these sensors are ON ("1") or "OFF". In FIGS. 5 thorugh 34, the manner of indication of diamond blocks is the same as the above. The meaning of "1" or "0" at each flow line corresponds to the active level or nonactive level of each signal shown in FIG. 3. For example, in block 31 in FIG. 5, the flow line "1" is selected when the sensor PX1 is ON, i.e., when no bill has been detected and the flow line "0" is selected when the sensor PX1 is OFF, i.e., when a bill has been detected. If a bill has been detected by any of the sensors, a flag f1 is set in block 32 whereas if none of the sensors has detected a bill, the flag f1 is reset. The state of the sensor P1R is not checked here. At END (end) exit, the program in this step has been completed and the step returns to the main routine (FIG. 4) for next processing.

Figure 6:
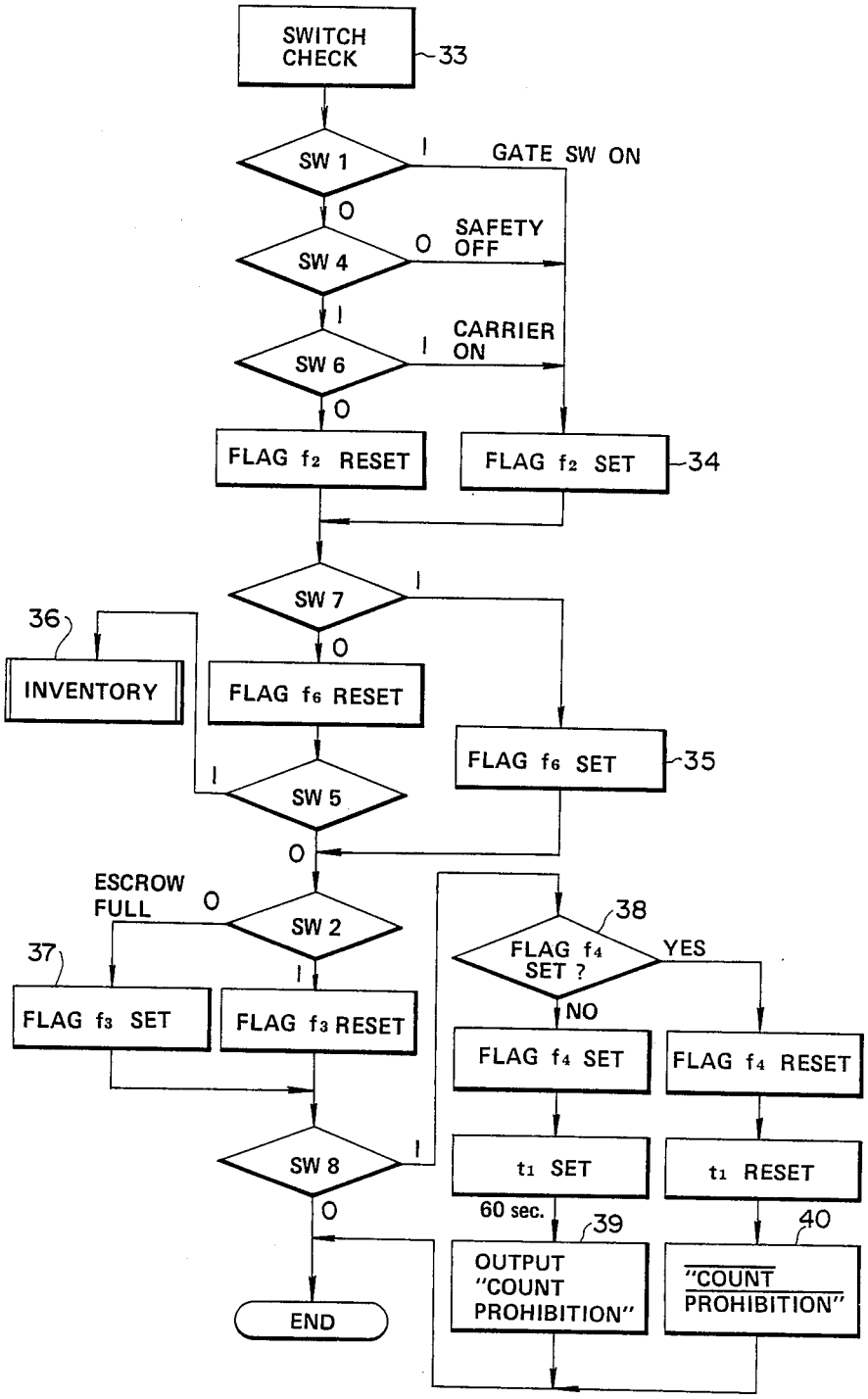

Details of a next switch check program 33 (FIG. 4) are illustrated in FIG. 6. In this step, outputs of the respective switches SW1–SW8 are checked. If the output of the switches SW1, SW4 or SW6 is of a non-active level, a flag f2 is set (block 34). If the switch SW7 has detected the state in which the stacker is full, a flag f6 is set (block 35). If the inventory switch SW5 is turned ON, an inventory subroutine 36 (FIG. 28(*a*), (*b*)) is executed. If the switch SW2 has detected the state in which the escrow section 13 is full, a flag f3 is set (block 37). If the switch SW8 has detected that a 1,000-yen bill for change is being manually inserted, whether a flag f4 is set or not is examined in block 38. If the flag f4 is not set, it is set and a timer t1 of 60 seconds is set (started) to provide a "count prohibition" signal (block 39). The bar symbol above the signal name as in block 40 signifies interruption of generation of that signal. Suffixes 1, 2, 3 . . . appended to the small letter t signify timers. Setting of a timer herein means starting of the timer operation.

Figure 7:
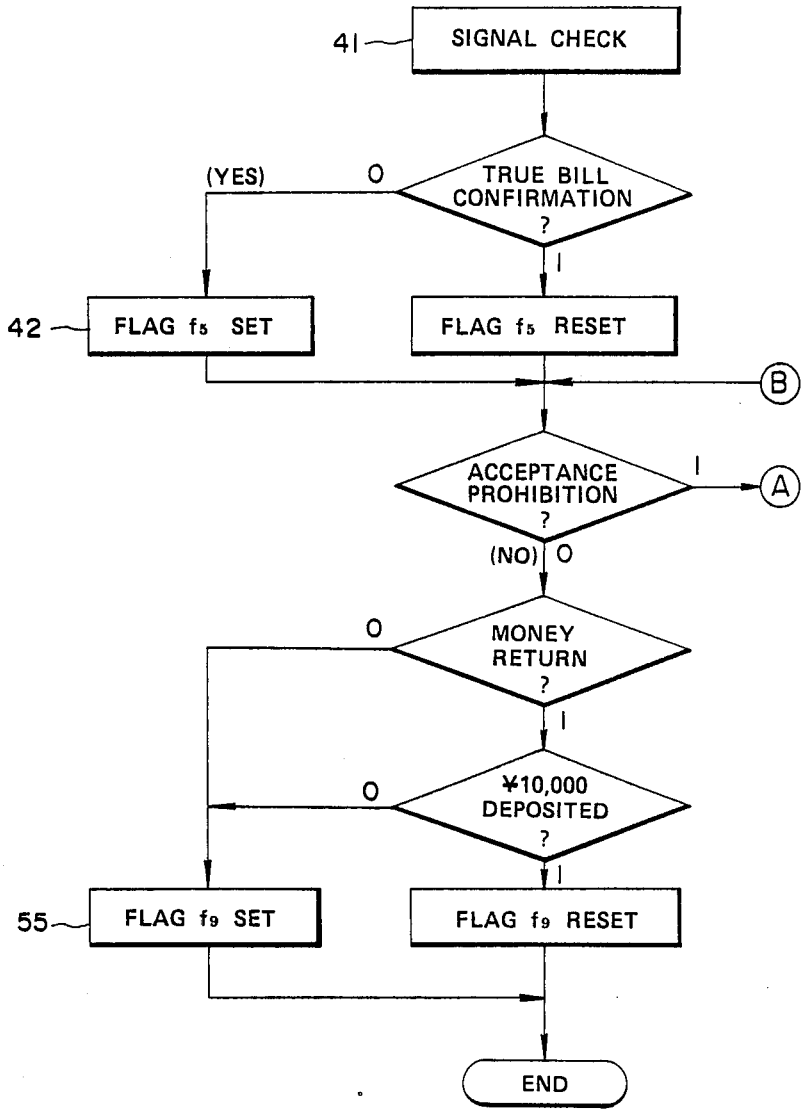
Figure 7B:
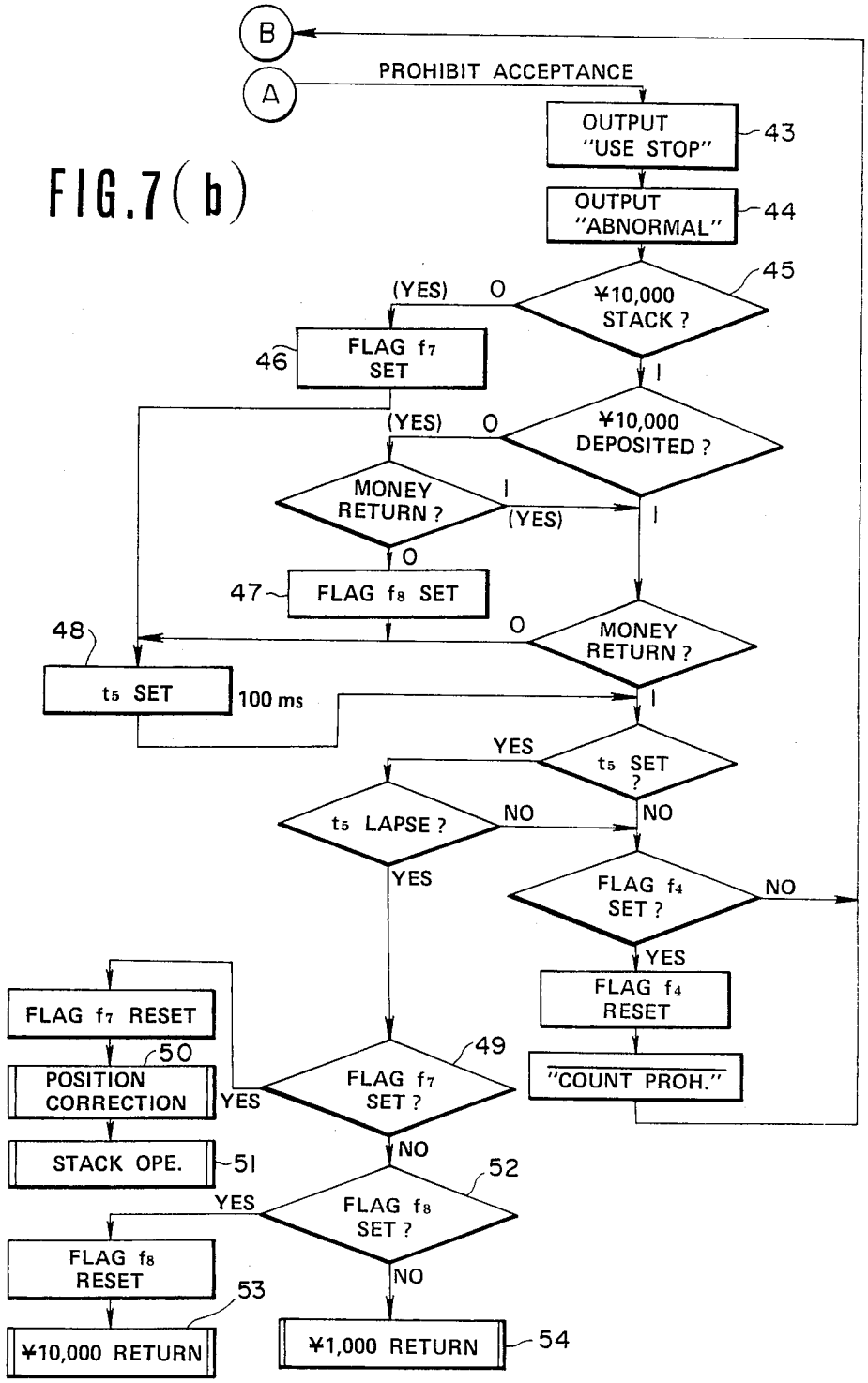
Figure 25:
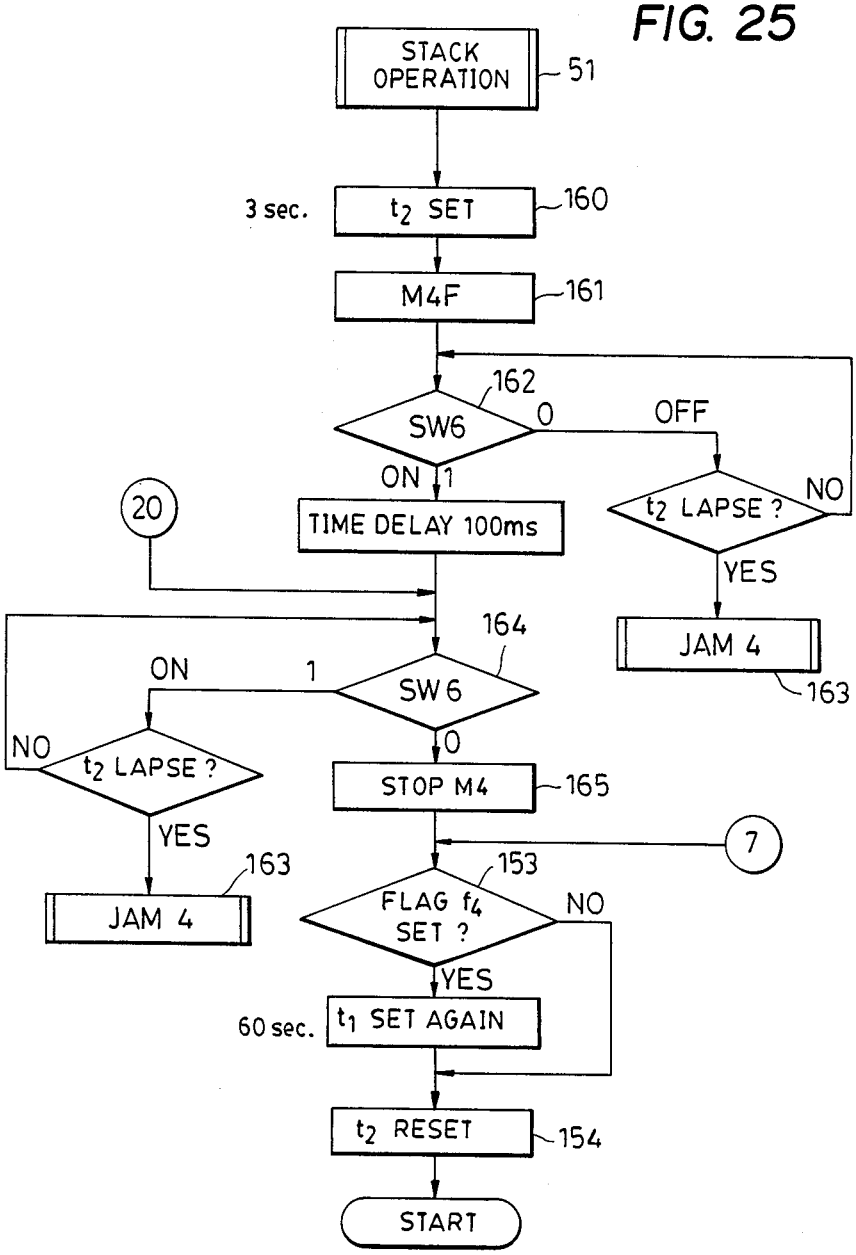
Figure 26A:
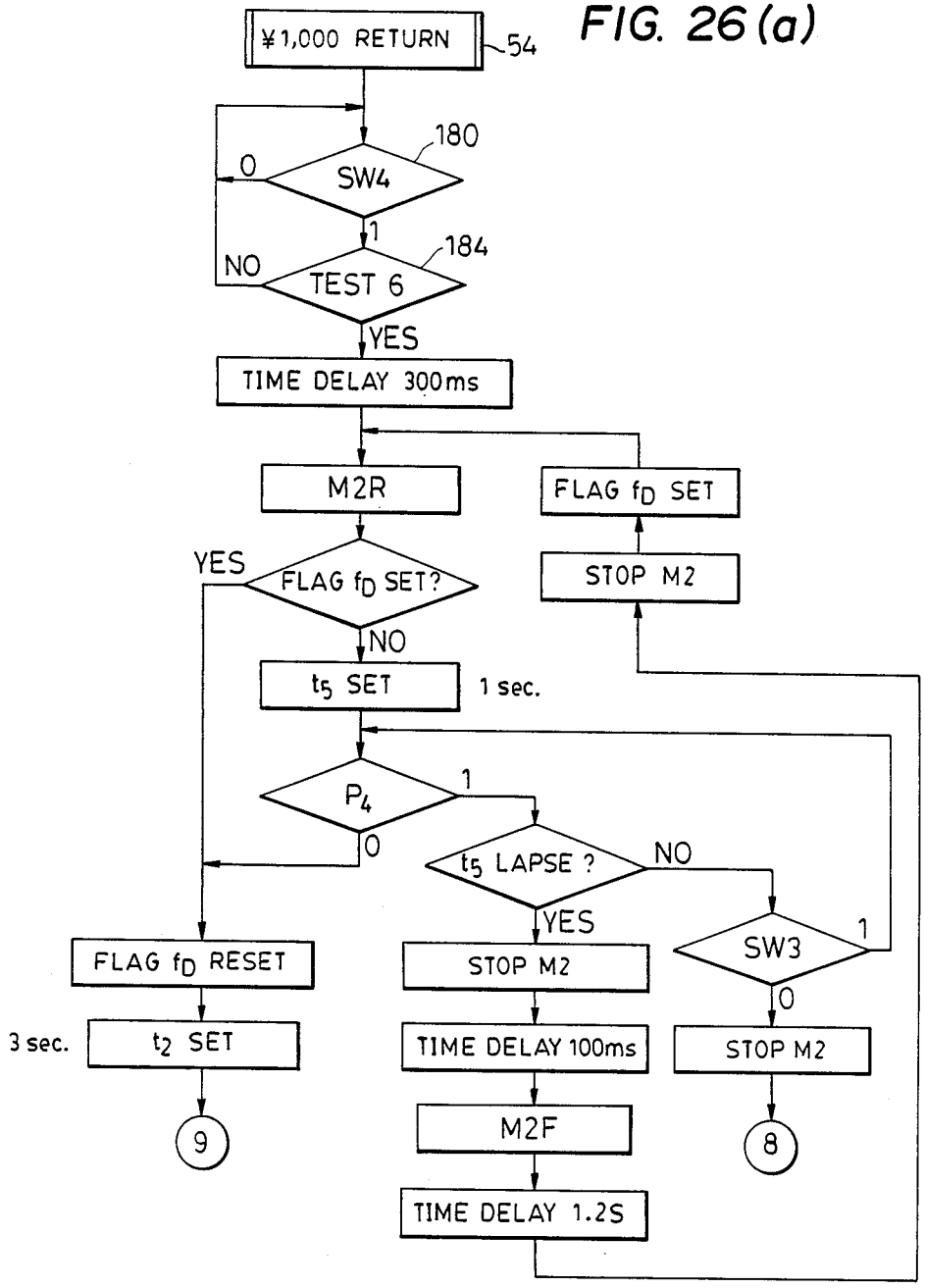
Figure 26B:
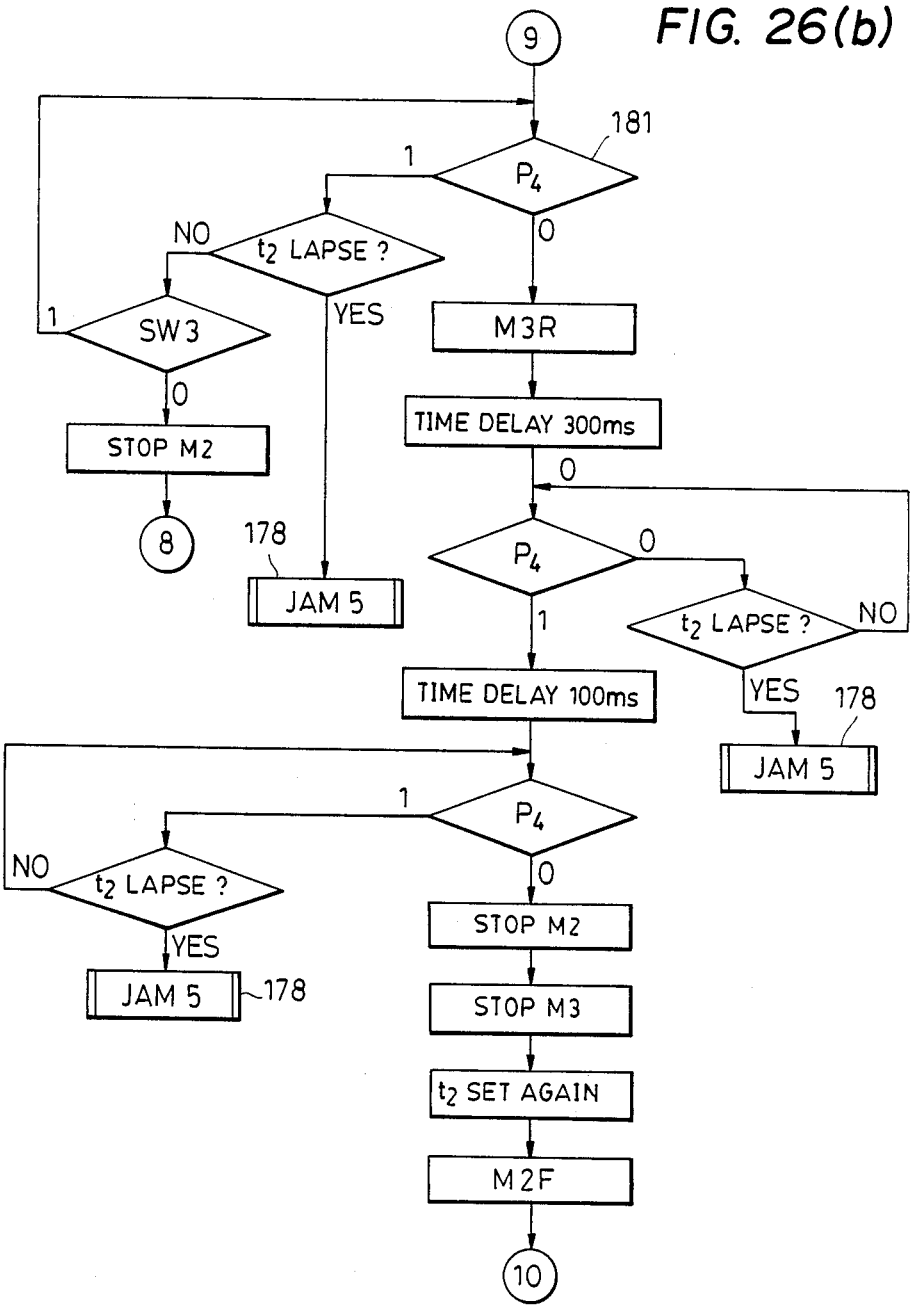
Figure 26C:
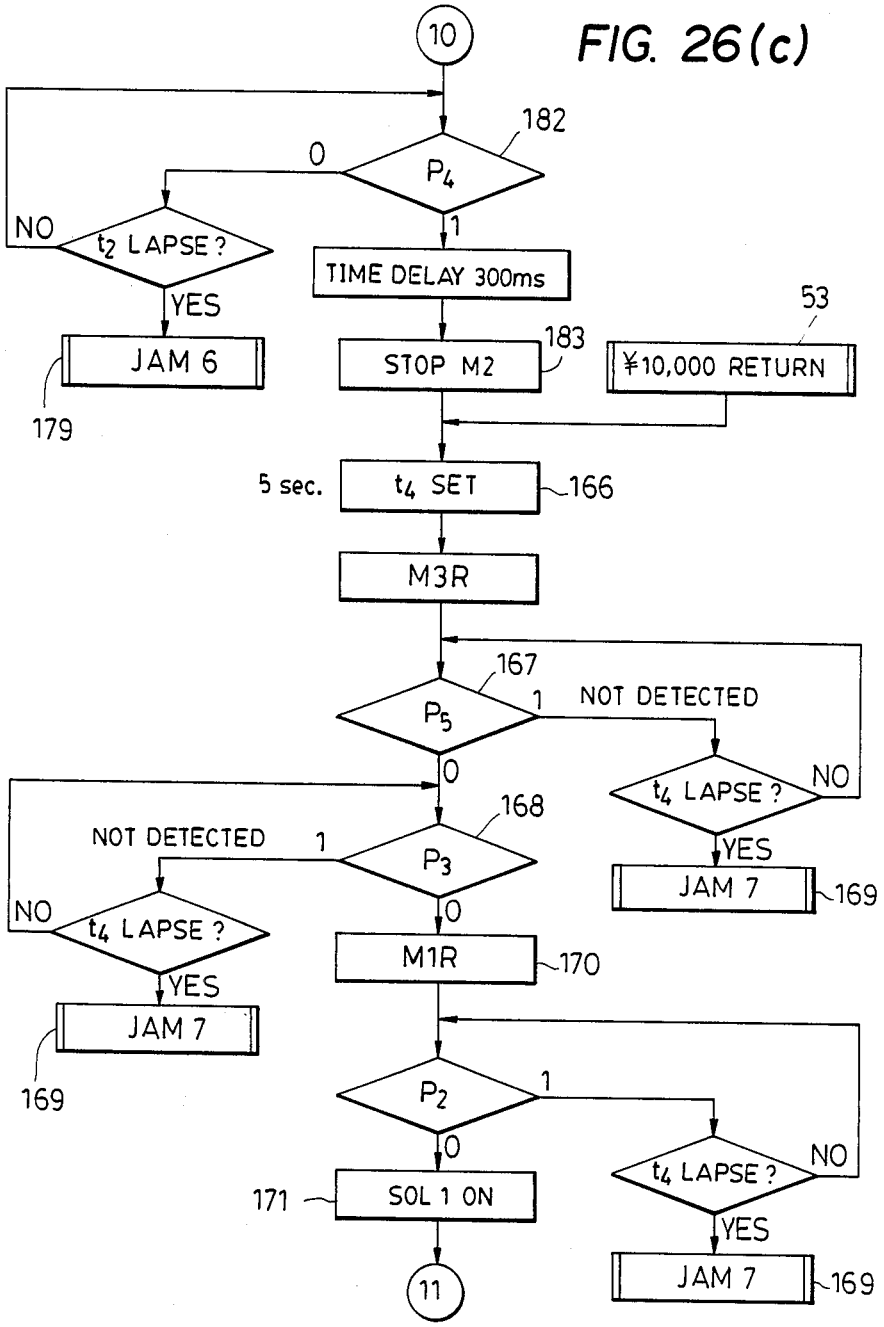
Figure 26D:
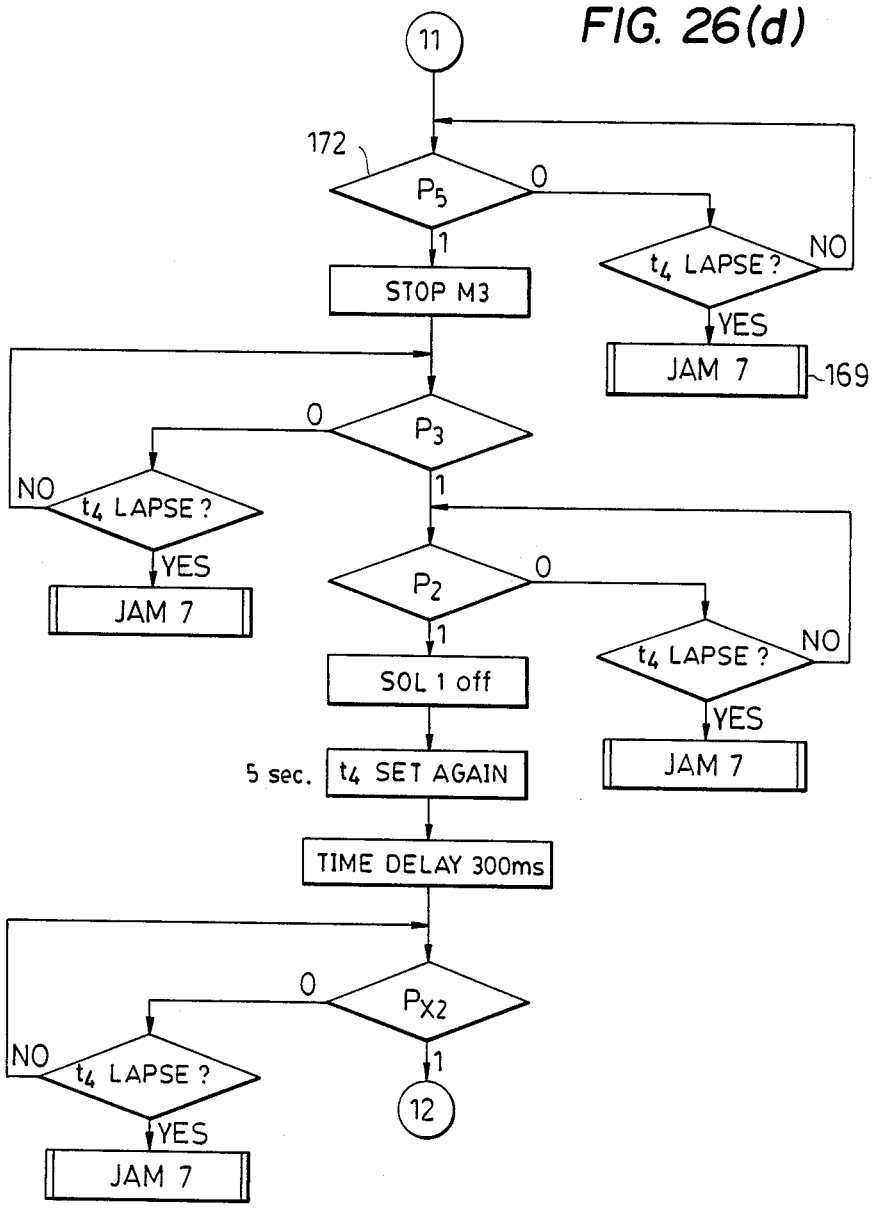
Figure 26E:
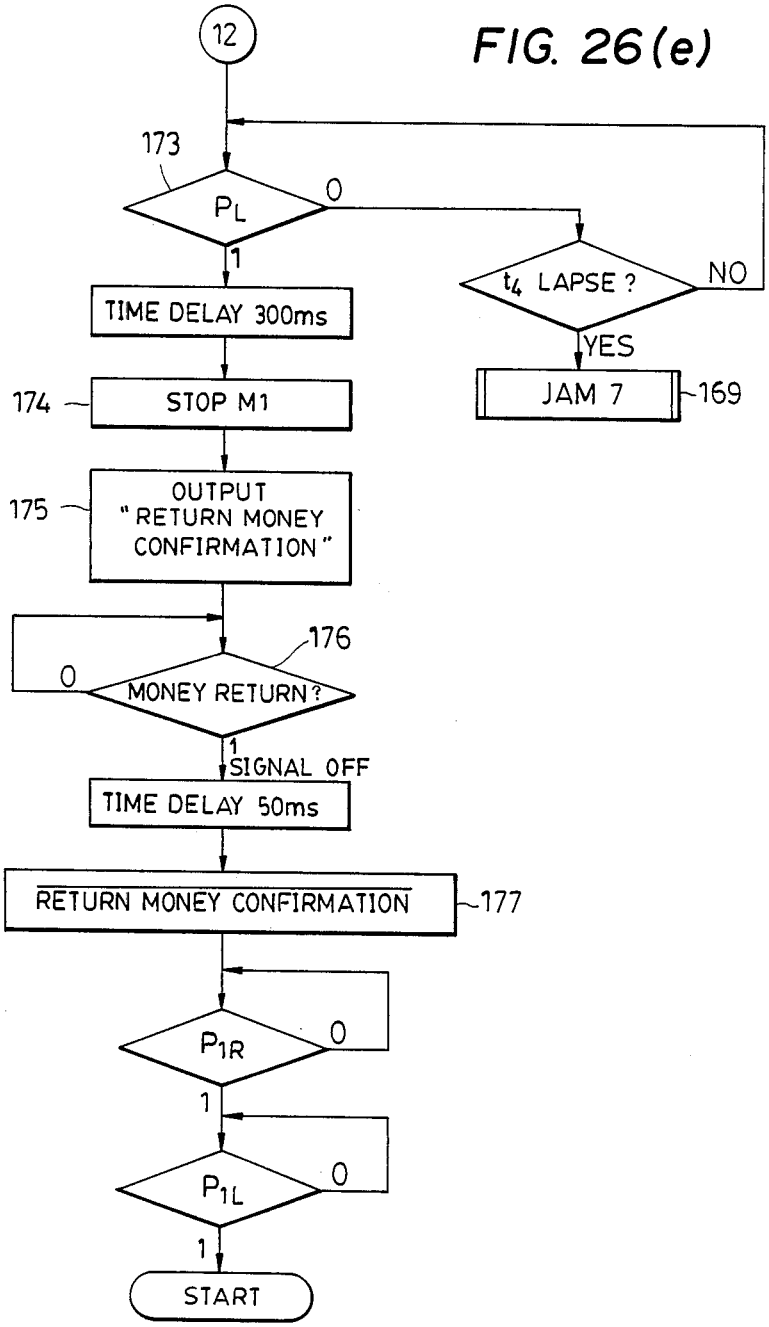
Figure 31:
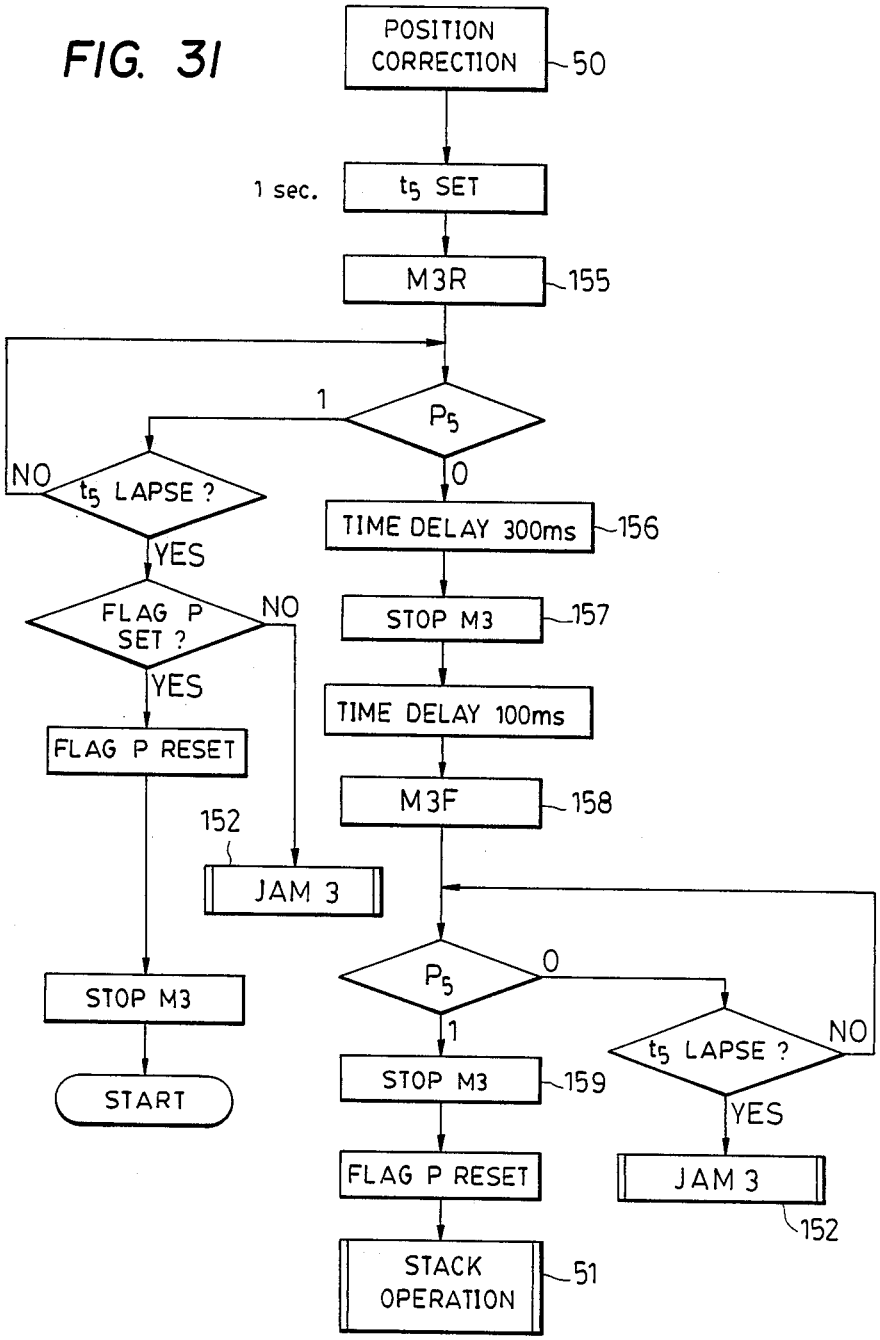

As the switch check program 33 has reached END, the step returns to the main routine and a signal check program 41 is started. Details of this program 41 are illustrated in FIGS. 7(*a*) and 7(*b*). In this program, states of the signals supplied from the control circuit 22 of the vending machine 21 to the control section 19 are checked. When the "true bill confirmation" signal is being generated at the non-active level ("0"), a flag f5 is set (block 42). When the "acceptance prohibition" signal is being generated at the active level ("1"), a "use stop" signal and an "abnormal" signal are produced by blocks 43 and 44 and whether the "10,000-yen stack" signal is being generated or not is examined in block 45. If a 10,000-yen bill is to be stored, a flag f7 is set (block 46). If the "10,000-yen stack" signal is not being generated whereas the 10,000-yen deposited signal and the "money return" signal are being generated, a flag f8 is set (block 47). This signifies that the 10,000-yen bill held in the passage 2 of the stacker section 12 is to be returned. When a true 1,000-yen or 10,000-yen bill which has once been accepted is to be returned or a 10,000-yen bill is to be stored, the step enters block 48 wherein a timer t5 of 100 ms is set (i.e., started). Upon lapse of the time set in the timer t5, whether a flag f7 is set or not is examined in block 49. If the result of the examination is YES, a position correction subroutine 50 (details are illustrated in FIG. 31) and a stack operation subroutine (details are illustrated in FIG. 25) are performed to store the 10,000-yen bill in the passage 2 of the stacker section 12 into the storing space 12*a*. In block 52, whether a flag f8 is set or not is examined. If the result is YES, a 10,000-yen return subroutine 53 (details are illustrated in FIG. 26(*c*)) is executed to return the 10,000-yen bill in the passage 2 of the stacker section 12 to the insertion slit 10. If the flag f8 is not set, a 1,000-yen return subroutine 54 (details are illustrated in FIGS. 26(*a*)–26(*e*)) is executed to return one 1,000-yen bill held in the escrow section 13. If the "money return" signal or the "10,000-yen deposited" signal is provided when the acceptance is not prohibited, a flag f9 is set by block 55.

Figure 8:
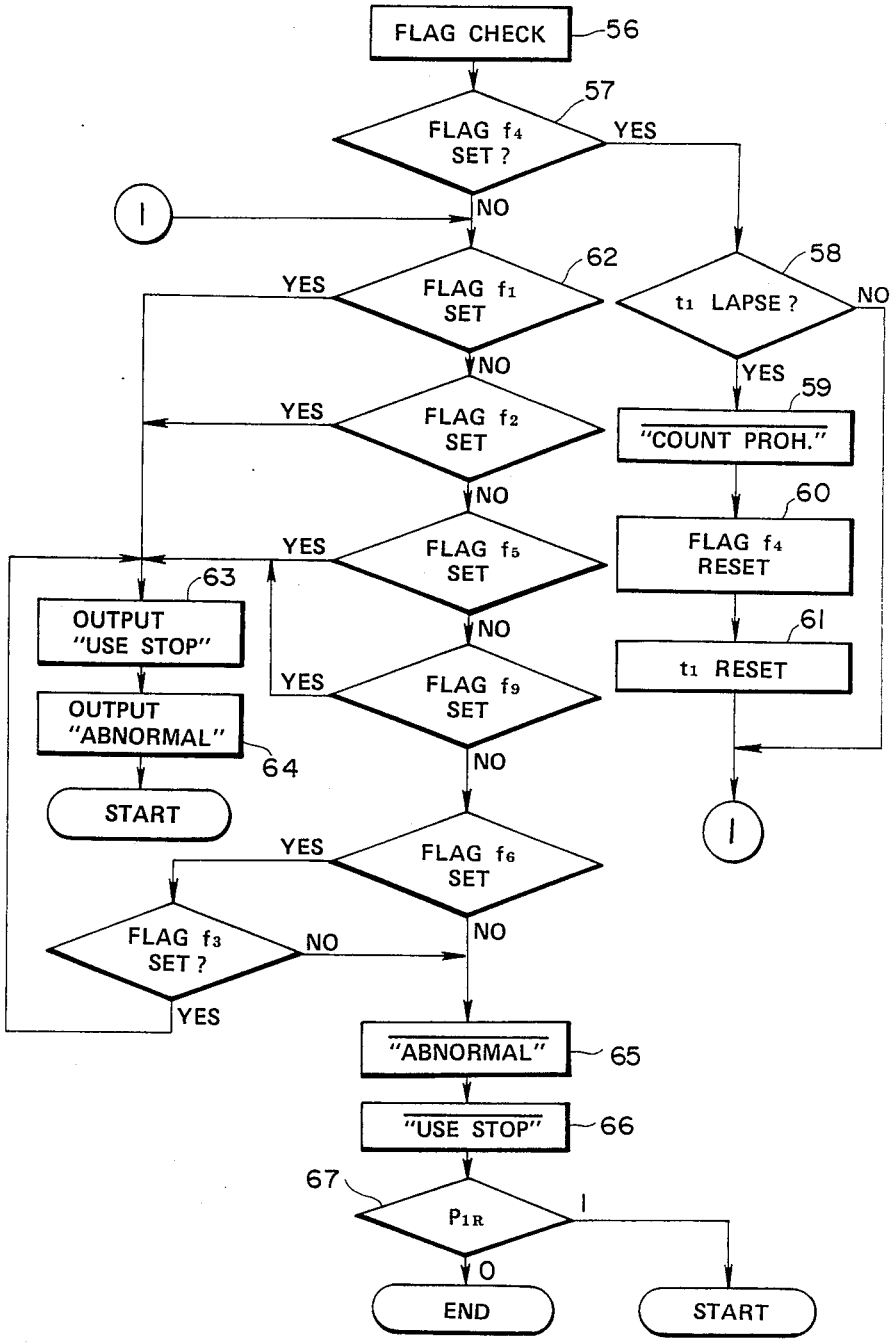

As the signal check program 41 has reached END, the step returns to the main routine and a flag check program 56 is performed. Details of this program 56 are illustrated in FIG. 8. In this program, states of the flags f1–f6 and f9 are checked. First of all, whether or not the flag f4 has been set in response to the turning ON of the manual insertion switch SW8 for the 1,000-yen bill for change is checked (block 57). If the result is YES, whether or not the operation time (60 seconds) of the timer t1 which has been set in the routine 33 in FIG. 6 has elapsed is examined (block 58). If the operation time has elapsed, processings of blocks 59, 60 and 61 are executed and then the step shifts to junction 1, i.e., block 62. When the flags f1, f2, f5 and f9 are set, the "use stop" signal and the "abnormal" signal are produced by processings in blocks 63 and 64. When the flags f6 and f3 representing the stack full and escrow full states are both set, the processings in blocks 63 and 64 are likewise performed. When all of the flags f1–f6 and f9 have been reset, the step proceeds to blocks 65 and 66 in which the abnormal signal and the use stop signal are cancelled. In next block 67, the state of the right side sensor P1R which is disposed nearest to the insertion slit 10 is checked. If no bill has been deposited, P1R is ON ("1") and the step returns to START of the main routine. When a bill has been deposited and the sensor P1R first detects the deposited bill, the flow line of "0" is selected in block 67 leading to END. Thereupon the step returns to the main routine to proceed to a bill receiving program 68.

Figure 9:
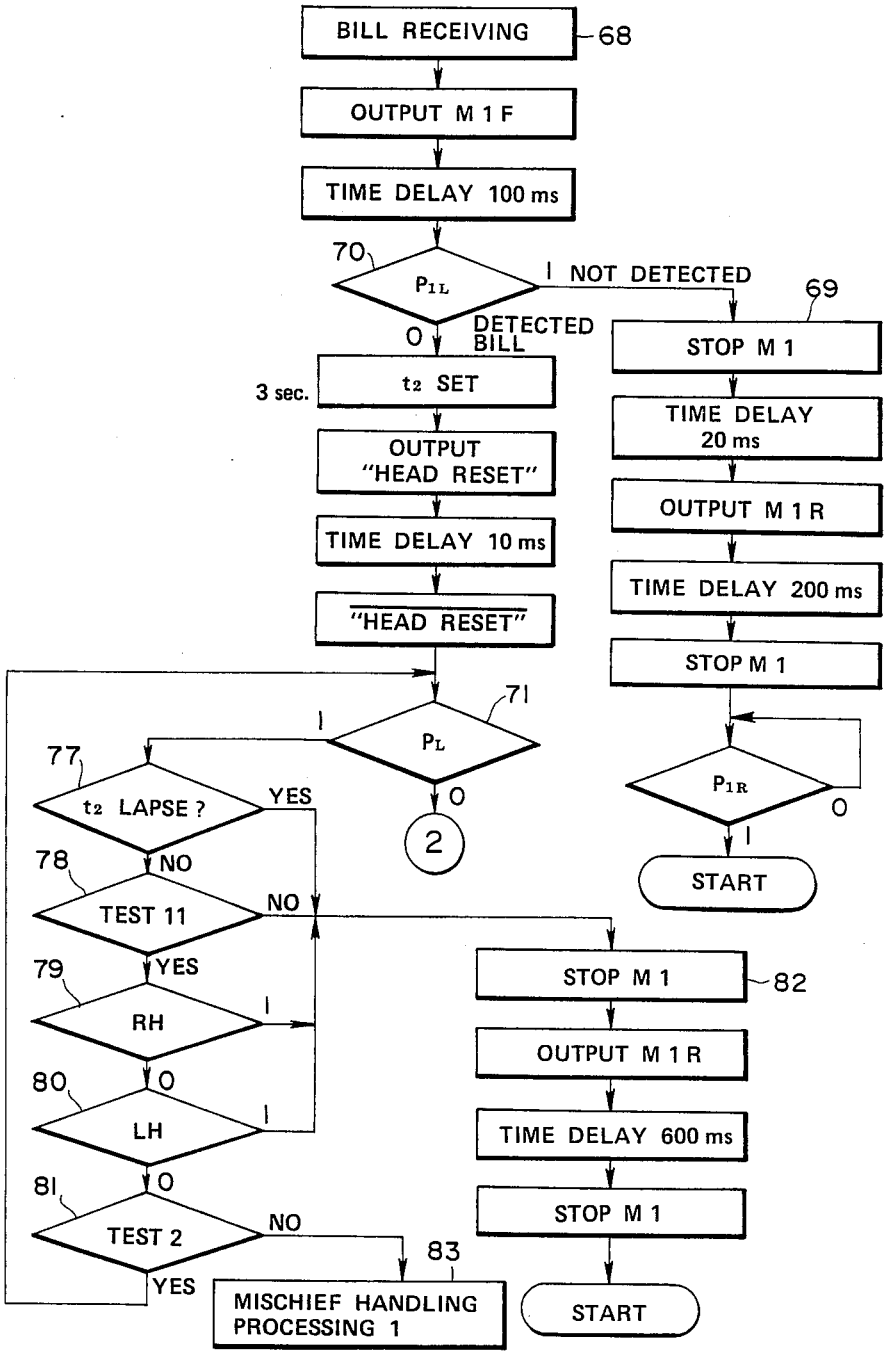
Figure 9B:
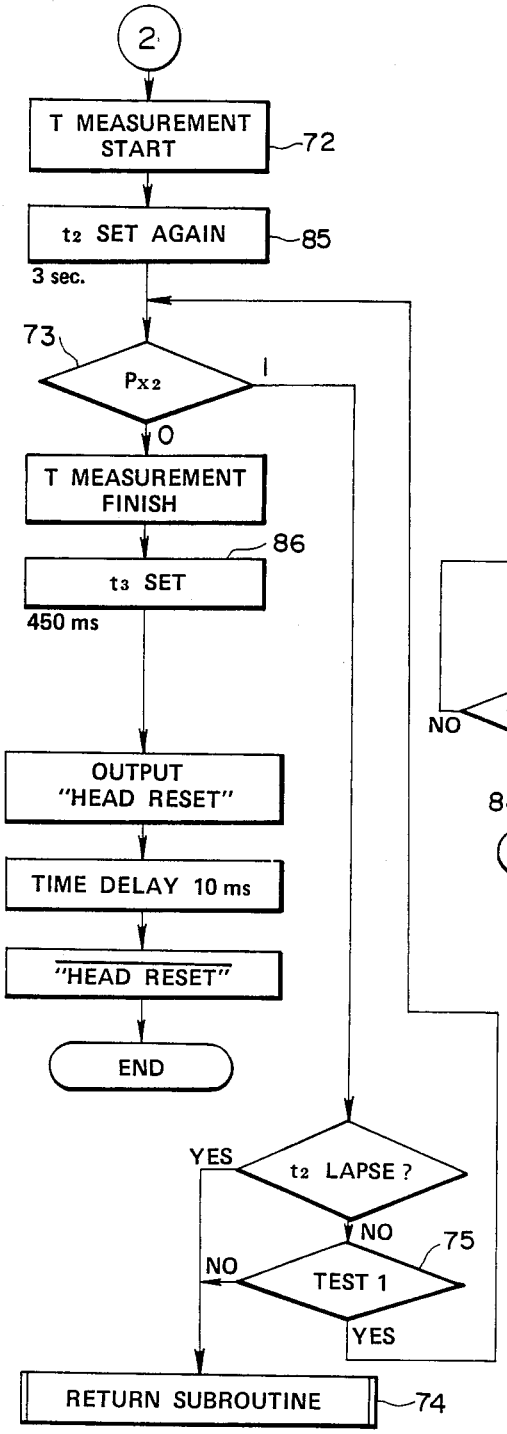
Figure 9C:
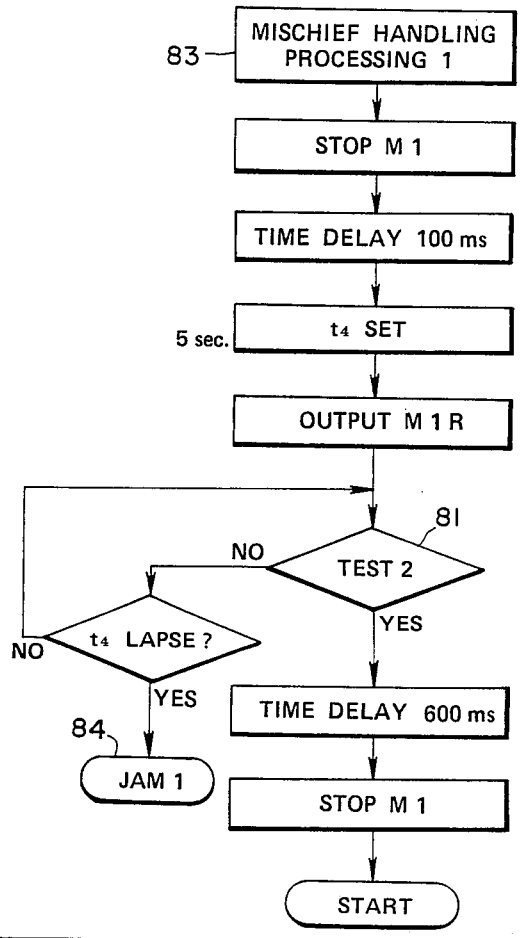

Details of the bill receiving program 68 are illustrated in FIGS. 9(*a*)–9(*c*). In this program, a signal M1F is first produced to rotate the motor M1 forwardly and thereby cause the bill to be pulled into the passage 1 and conveyed in the forward direction. The block affixed with characters 100 ms signifies that a waiting-time of 100 ms is set there. Other time delay blocks function in a similar manner. If the left side sensor P1L has not detected the bill by the lapse of the waiting-time of 100 ms, this signifies an abnormal state so that the motor M1 is stopped (block 69) and a signal M1R is produced to rotate the motor M1 reversely for a predetermined period of time and thereafter the step returns to START. On the other hand, if detection of a bill by the sensor P1L has been confirmed in block 70, a head reset signal is produced for a predetermined period of time and the step proceeds to block 72 of FIG. 9(*b*) through a junction 2 on condition that the sensor PL has detected the bill in block 71. "T measurement" means measurement of time T elapsing for advancing of the leading edge of the bill from the sensor PL to the sensor PX2 which time T is determined by the velocity of the motor M1. Accordingly, when the detection of a bill by the sensor PX2 has been confirmed in block 73, the "T measurement" is completed. The step then proceeds to END and the receiving program 68 is finished.

Figure 18:
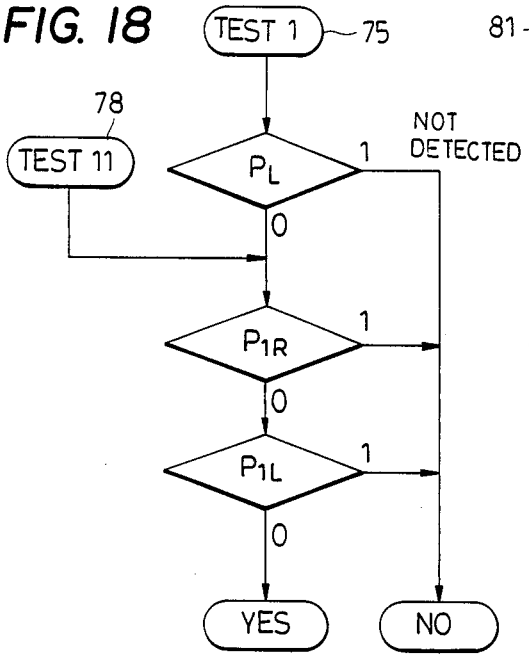

If, on the other hand, the sensor PX2 has not detected a bill within the operation time (3 seconds) of the timer t2, a return subroutine 74 is executed in response to "t2 elapse" YES. During the operation time of the timer t2, i.e., the T measurement, a TEST 1 routine 75 is executed. Details of this TEST 1 routine are illustrated in FIG. 18. In the TEST 1 routine, whether the sensors PL, P1R and P1L have detected the bill or not is judged. If these sensors have not detected the bill at this time, this signifies an abnormal state and the step proceeds from NO of block 75 to the return subroutine 74.

Figure 21:
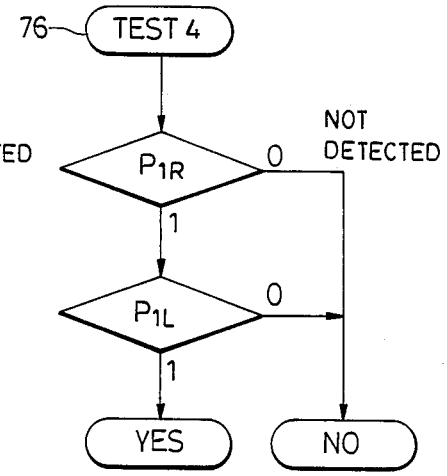
Figure 27:
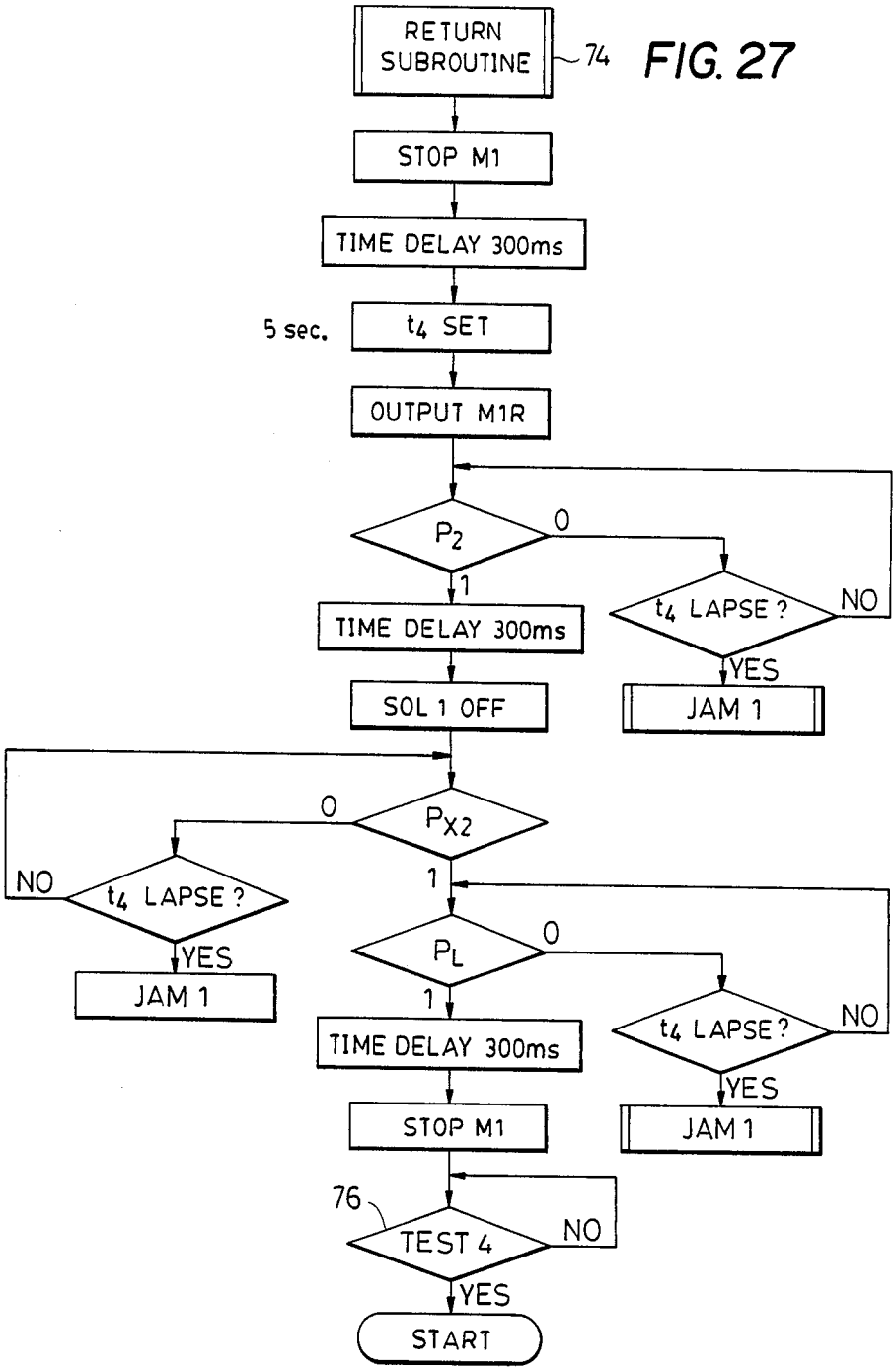

Details of the return subroutine 74 are illustrated in FIG. 27. In the return subroutine 74, the motor M1 is rotated reversely to return the bill in the passage 1 to the insertion slit 10. Details of a TEST 4 routine 76 are illustrated in FIG. 21.

Figure 19:
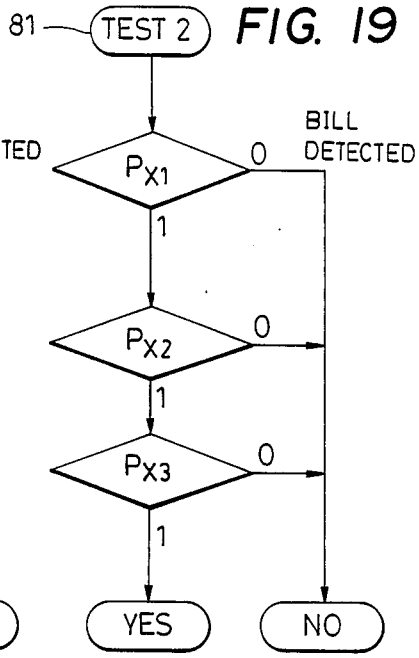
Figure 20:
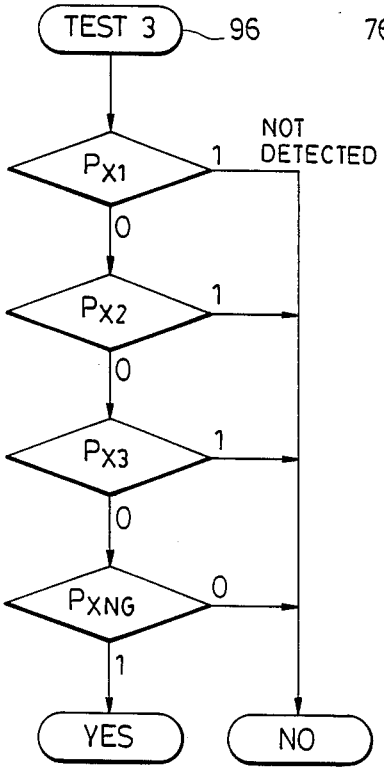
Figure 33:
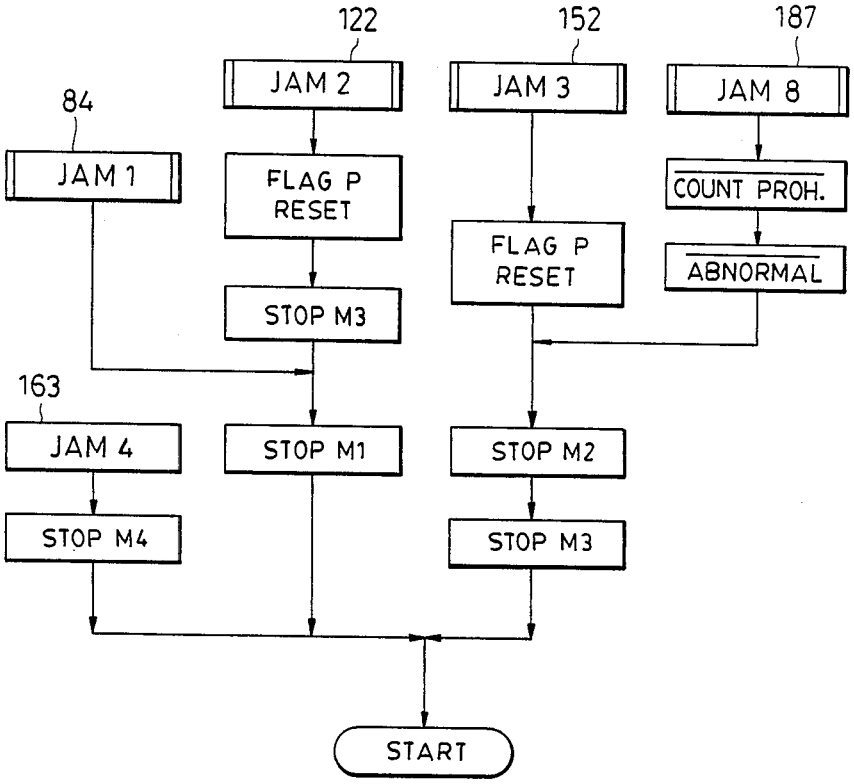

Reverting to FIG. 9(*a*), the processings of loop of block 77 through 81 are repeated until the detection of the bill by the sensor PL is confirmed in block 71. In a TEST 11 routine 78, states of the sensors P1R and P1L are examined as shown in FIG. 18. In blocks 79 and 80, whether or not the magnetism detection heads RH and LH have detected magnetism is examined. In a TEST2 routine 81, states of the sensors PX1–PX3 are examined as shown in FIG. 19. If the judgements of blocks 77–80 indicate an abnormal state, the step proceeds to block 82 in which the motor M1 is stopped and then rotated reversely for a predetermined time to return to START. If a TEST2 routine 81 is NO, i.e., the sensors PX1–PX3 have detected the bill, a mischief handling processing 1 program 83 shown in FIG. 9(*c*) is executed. In this program 83, the motor M1 is rotated reversely for a predetermined period of time to execute the TEST 2 routine 81 again and thereafter the step returns to START. JAM1 routine 84 signifies returning to START after stopping of the motor M1 as shown in FIG. 33.

Figure 24:
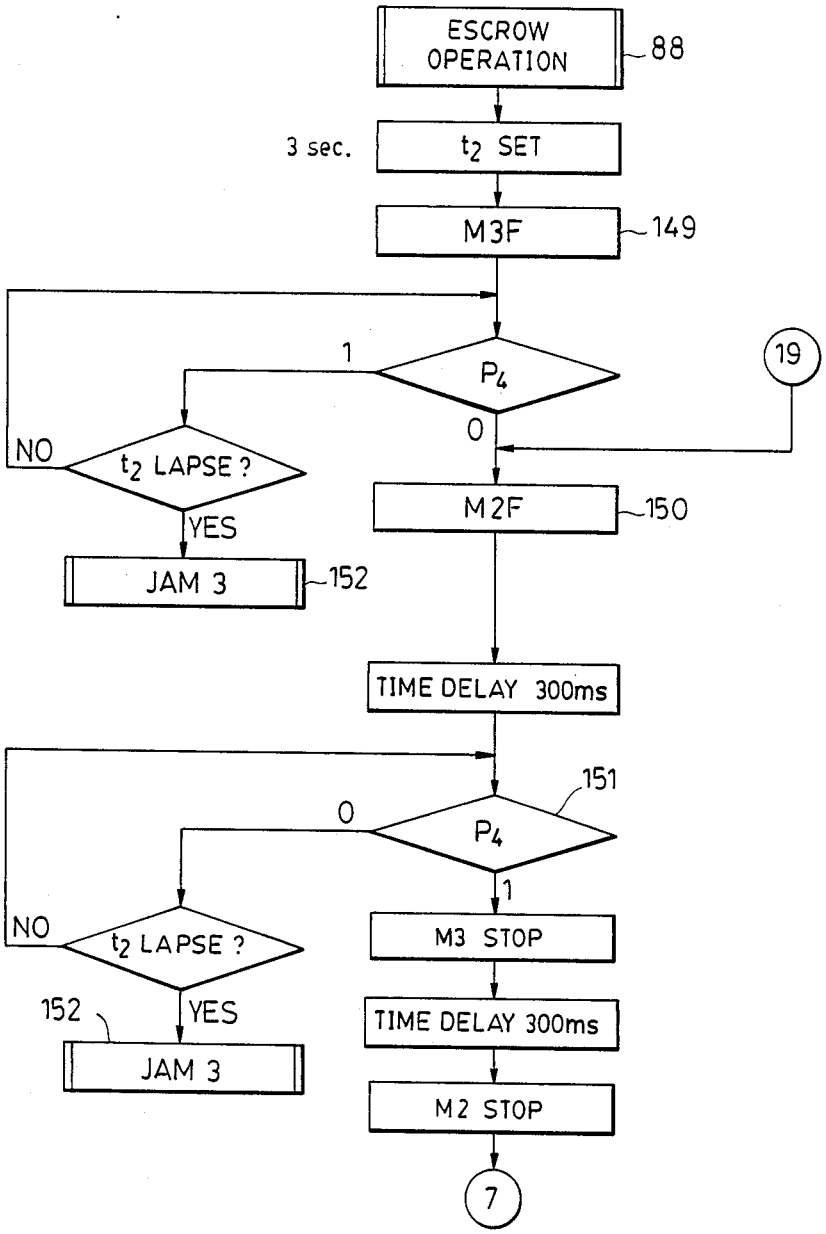

As will be apparent from the above description, when a bill has been deposited in a normal manner, the bill receiving program 68 reaches END in a state in which the timers t2 and t3 are set in blocks 85 and 86 (FIG. 9(*b*)) and the bill has been detected by the sensor PX2 (the flow line "0" of block 73). The forward rotation of the motor M1 is maintained. Upon reaching of the bill receiving program 68 to END, the step proceeds to a discrimination operation program 87 of the main routine (FIG. 4). Details of this program 87 are illustrated in FIGS. 10 through 17. In this program, whether the deposited bill is a true bill or not is judged from the outputs of the respective sensors and the mangetism detection heads. If the bill has been judged to be not true, the return program 74 is executed and the deposited bill in the passage 1 is returned to the insert slit 10. This return program 74 is the above described return subroutine 74 (FIG. 27). If the bill has been judged to be true in the program 87, an escrow operation program 88 is executed when the bill is a 1,000-yen bill whereby the bill is stored in the escrow section 13. If the deposited bill is a 10,000 yen bill, it is held in a standby state in the passage 2 of the stacker section 12 and thereafter is stored in the storing space 12*a* of the stacker section 12 by executing a stacker operation program 51 under predetermined conditions. In a case where the bill which has been once received as a true bill is automatically returned to the insertion slit 10 for the reason that the "true bill confirmation" signal has not been given or for other reason, the money return programs 53 and 54 are executed. Details of these programs 88, 51, 53 and 54 are illustrated in FIGS. 24, 25 and 26(*a*) through 26(*e*) all of which are subroutines.

Figure 10:
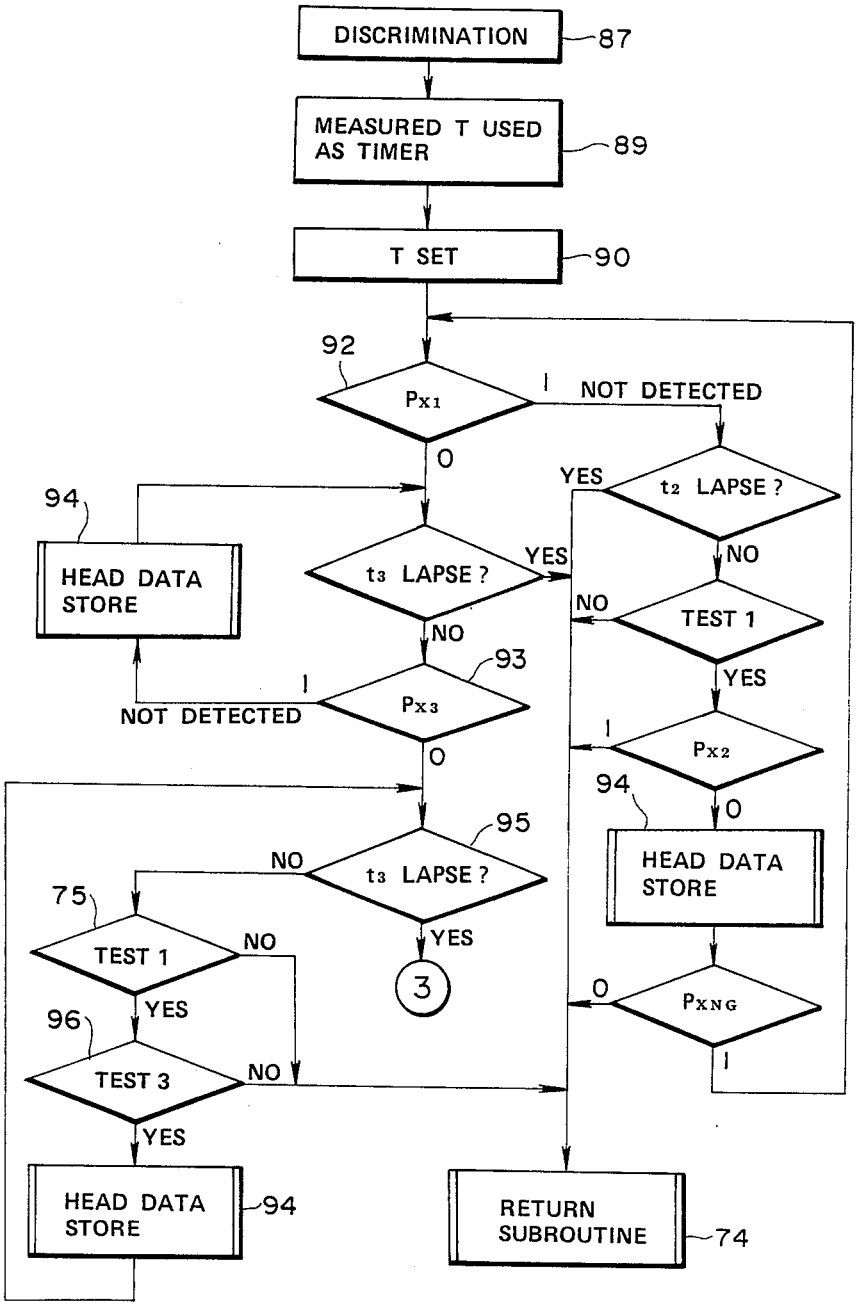

Referring to FIG. 10, in the discrimination operation program 87, the time T which has been measured in the routine of FIG. 9(*b*) is set as the operation time of the timer (block 89). In next block 90, the timer of the operation time T thus set is started. When the sensors PX1 and PX3 have not detected a bill (i.e., when the flow line "1" in blocks 92 and 93 has been selected), the loop including a head data store subroutine 94 is executed. As the leading edge of the bill has been detected by the sensors PX1 and PX3, the step proceeds to the flow line "0" of block 93. If the operation time of the previously set timer t3 has not finished yet, the TEST 1 routine 75 and the TEST 3 routine 96 (FIG. 20) and a head data store subroutine 94 in the NO loop of block 95. When the operation time of the timer t3 has elapsed, the step proceeds from a junction 3 to block 97 in FIG. 11. If judgement indicating the abnormal state has been made in the respective judgement blocks in FIG. 10, the return subroutine 74 is executed.

Figure 11:
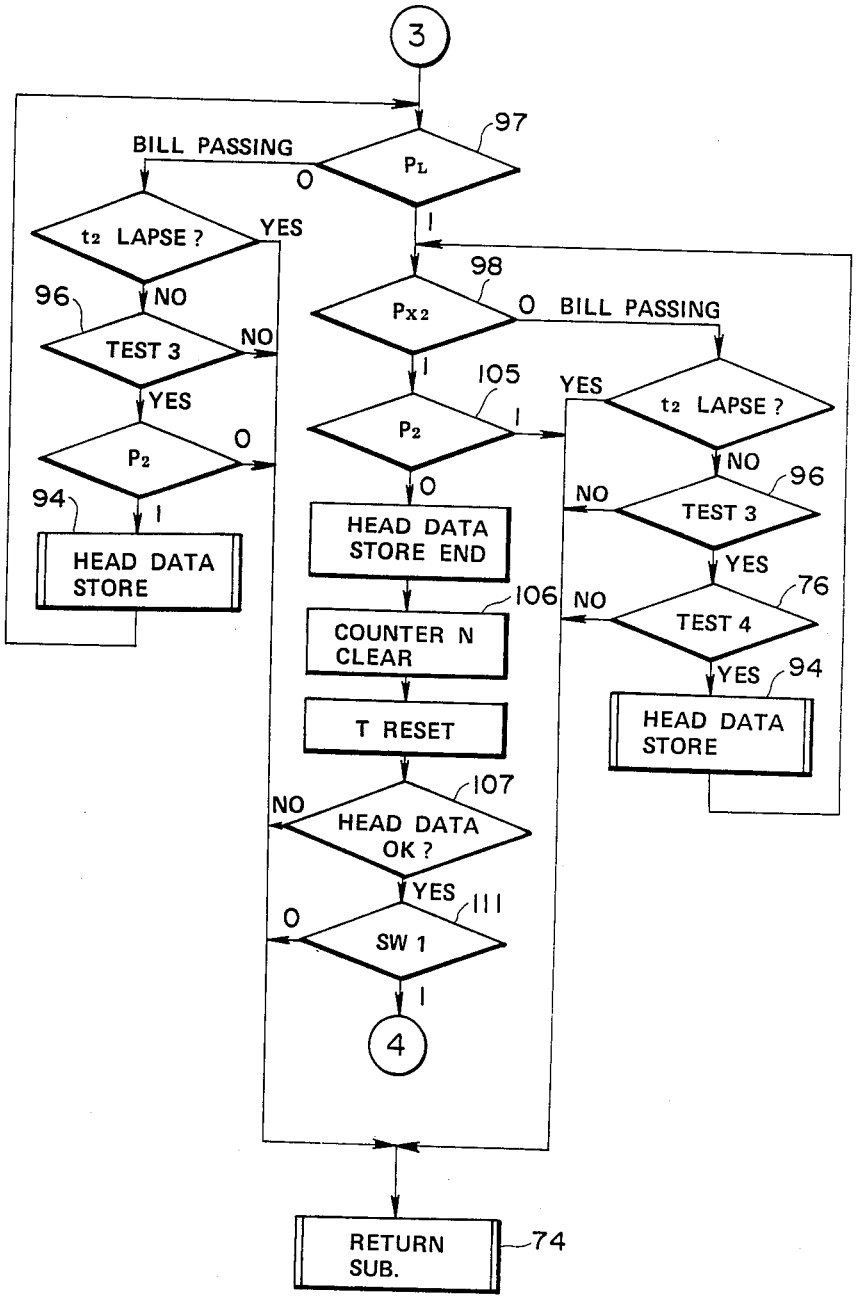

Referring to FIG. 11, whether or not the sensor PL has detected a bill is examined in block 97. While a bill is passing by the sensor PL, a head data store subroutine 94 is executed in the loop of the flow line "0" of block 97. While the rear edge of the bill is passing by the sensor PX2 after the sensor PL, the subroutine 94 is executed in the loop of the flow line "0" of block 98.

Details of the head data store subroutine 94 are illustrated in FIG. 15. In this subroutine, the portion of the longitudinal length of the bill corresponding to the distance between the sensors PL and PX2 (time for conveying the bill corresponding to this distance is T) is taken as one unit and each output data of the respective magnetism heads CH, RH and LH in this one unit is stored. By repeating this subroutine 94, a total of 10 units of magnetism head output data is stored.

If the operation time T (the measured time T) has not elapsed, the processings proceed from the flow line NO in block 99 to block 100 in which the output data ("1" or "0") of the respective heads CH, RH and LH is loaded in an address designated by a counter N. In block 101, output data ("1" or "0") of the thickness sensor PXNG is loaded in a corresponding address.

When the operation time of the timer T has elapsed, the counter N is counted up by 1 count by block 102. In block 103, whether or not the count of the counter N is 10 or less is examined and, if the count is 10 or less, the timer T is set in block 104 to start the operation time T again. The magnetism head output data and thickness data for 10 addresses is stored by repetition of this process. Upon reaching of the count value of the counter N to 11, block 103 becomes NO and the timer T is not set any longer.

Reverting to FIG. 11, when the rear edge of the bill has passed by the sensor PX2, the step proceeds from a flow line "1" of block 98 to block 105 and, on the condition that the sensor P2 has detected the bill at this time (i.e., if the condition that the total length of the true bill is larger than the distance between the sensors PX2 and P2 is satisfied), the head data storing is completed, the counter N is cleared (block 106) and the timer T is reset.

Figure 16:
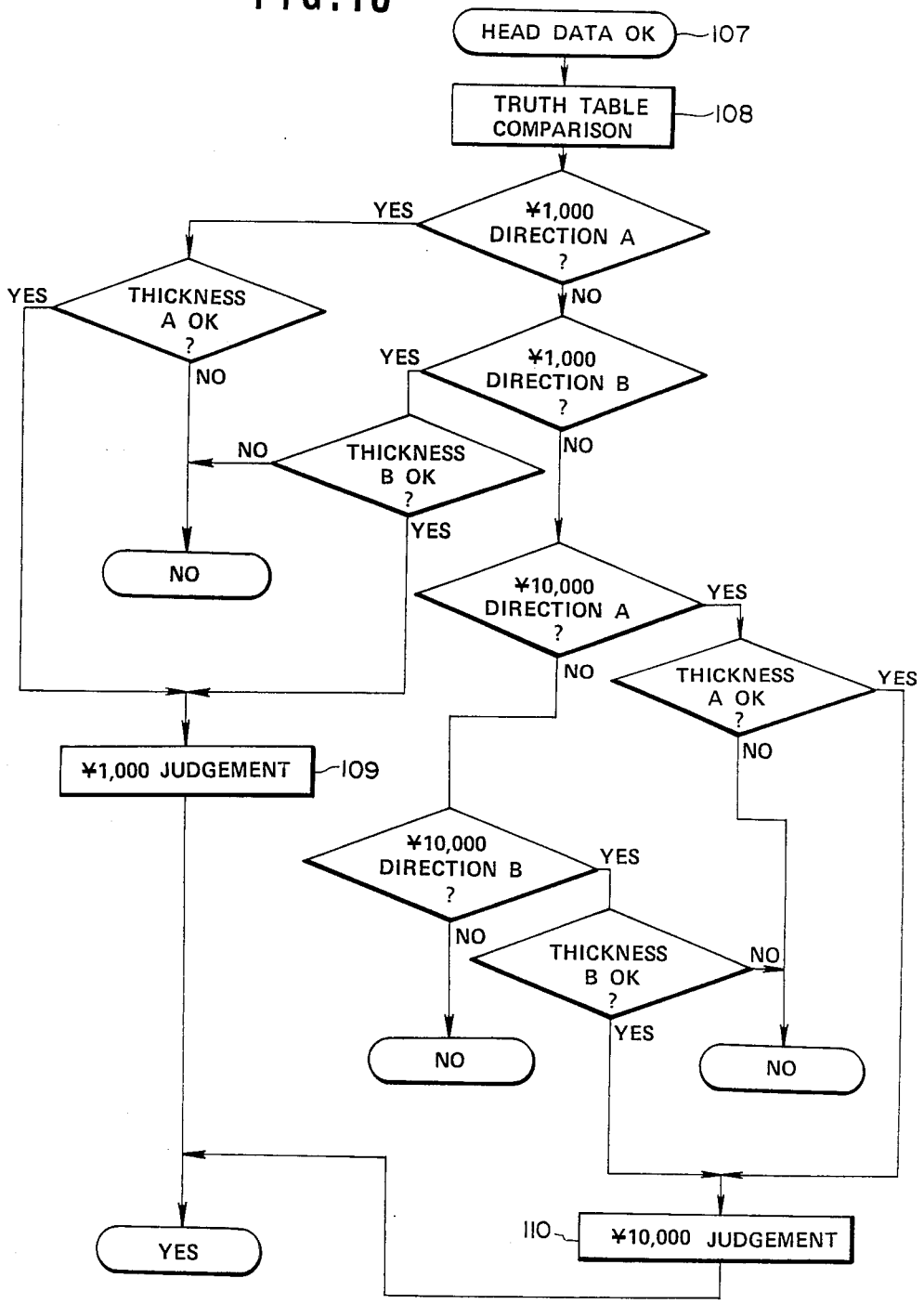

In a next head data OK routine 107, a truth table consisting of 10 addresses of the magnetism head output data and thickness data stored in the head data store subroutine 94 is compared with a reference truth table which has been made previously to determine whether the deposited bill is a true bill or not. Details of this routine 107 are illustrated in FIG. 16. In block 108, the above described comparison of truth tables is performed and in other blocks whether the result of the comparison satisfies predetermined conditions of the true bill or not is judged one by one. Directions A and B signify two directions of inserting the bill. A 1,000-yen bill ($\gtrneqless$1,000) or a 10,000-yen bill ($\gtrneqless$10,000) is inserted in either the direction A or B so that the bill has only to satisfy the true bill conditions of either direction. In this manner, if judgement has been made that the bill does not satisfy the conditions of a true bill, the step proceeds to the exit of NO whereas if the bill has been judged to satisfy the conditions of a true bill, judgement is made as to whether the bill is a 1,000-yen bill or a 10,000-yen bill (blocks 109 and 110), this result of judgement is stored and the step proceeds to the exit of YES.

Figure 22:
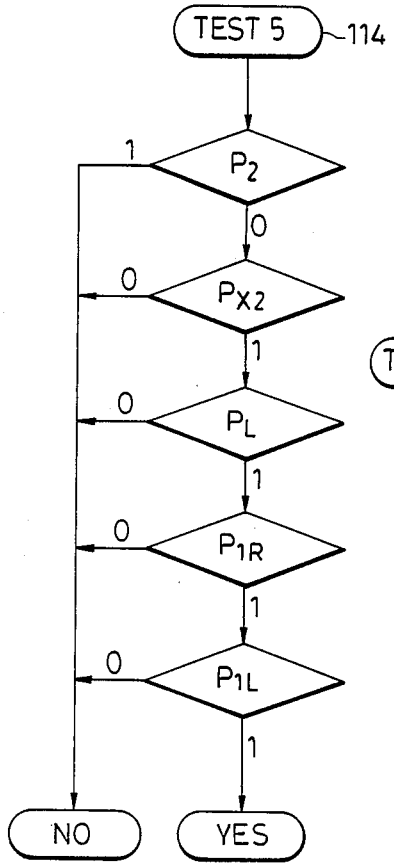

Reverting to FIG. 11, if the result of judgement in the routine 107 is NO, the return subroutine 74 is executed to return the deposited bill. If the result is YES, the state of the gate switch SW1 is examined in block 111 and, if the bill is passing through this place, the step proceeds to a next step (a junction 4 in FIG. 12). In block 112 in FIG. 12, the gate switch SW1 is examined again and, while the bill is passing through this place, the loop of the flow line "1" of block 112 is repeated to check presence or absense of an abnormal state. If there is an abnormal state, a signal SOL1ON energizing the solenoid SOL1 is produced (block 113) and the step proceeds to the return surbroutine 74. In this step, the solenoid SOL1 is energized to cause the gate lever 6 to be withdrawn from the passage 1 and feed back the bill without inconvenience. Details of the TEST 5 routine 114 are illustrated in FIG. 22.

Upon passing of the bill by the gate lever 6, the step proceeds from the flow line "0" of block 112 to block 115 in which the storage of the result of judgement in the above described head data OK routine 107 (FIG. 16) is read out to determine whether the deposited bill is a 1,000-yen true bill or 10,000-yen true bill. Upon this determination, a "1,000-yen true bill" signal or a "10,000-yen true bill" signal is produced (blocks 116, 117). As described above, the counter 23 or 25 (FIG. 3)

of the control circuit 22 counts up the deposited bill in response to this true bill signal.

Figure 17:
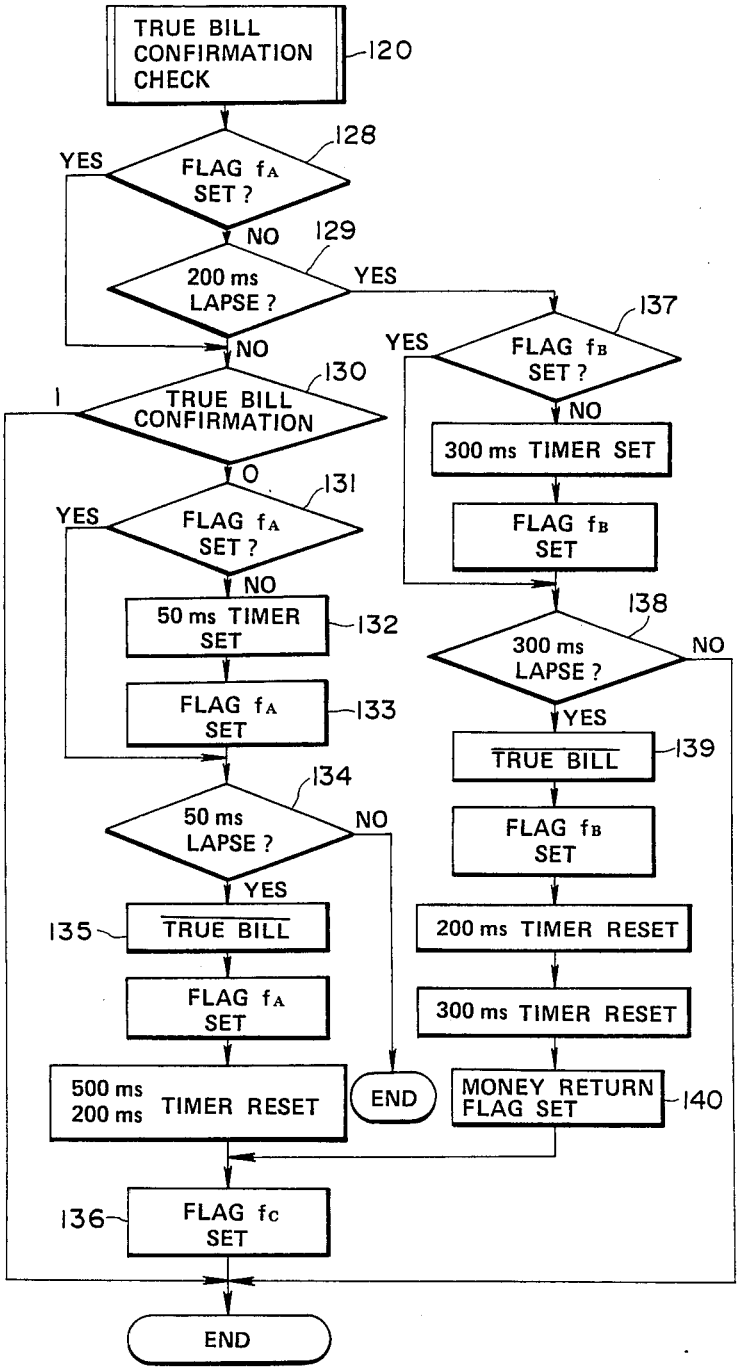
Figure 32:
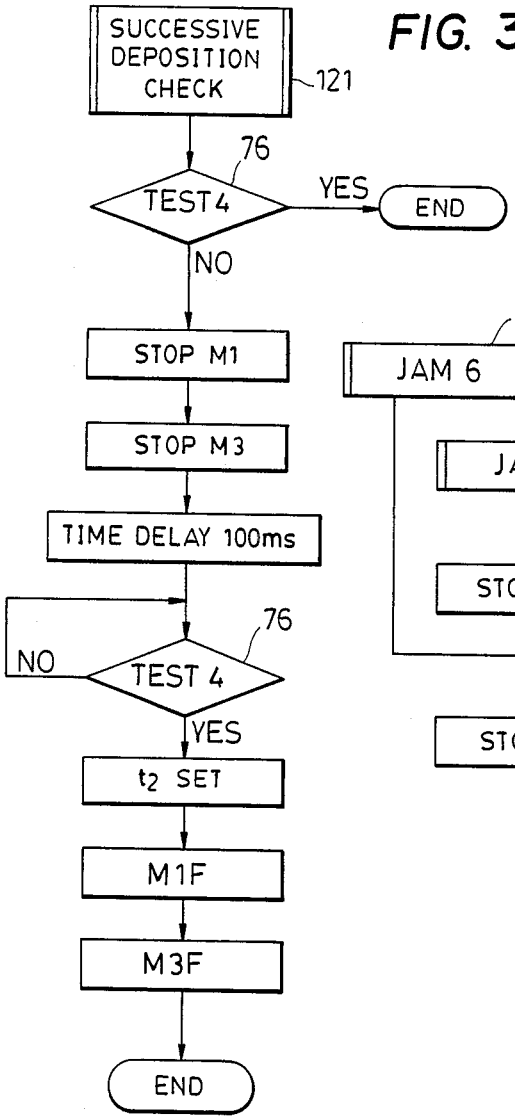

In a next routine, a timer of 200 ms is set in block 127 and the output of the sensor P3 is examined in block 118. If the bill has not reached the position of the sensor P3, the loop of the flow line "1" of block 118 is repeated to examine the true bill confirmation check flag fc (block 119). If this flag fc has not been set yet, a true bill confirmation check subroutine 120 (details are illustrated in FIG. 17) is executed whereas if this flag fc has already been set, a successive deposition check subroutine 121 (details are illustrated in FIG. 32) is executed. Details of a JAM2 subroutine 122 which is executed upon "t2 elapse" YES in this loop are illustrated in FIG. 33. Since a state in which the sensor P3 has not detected a bill by the lapse of the operation time t2 of 60 seconds is abnormal, processings including resetting of the flag P and the stopping of motors M3 and M1 are performed and then the routine returns to START.

Figure 12:
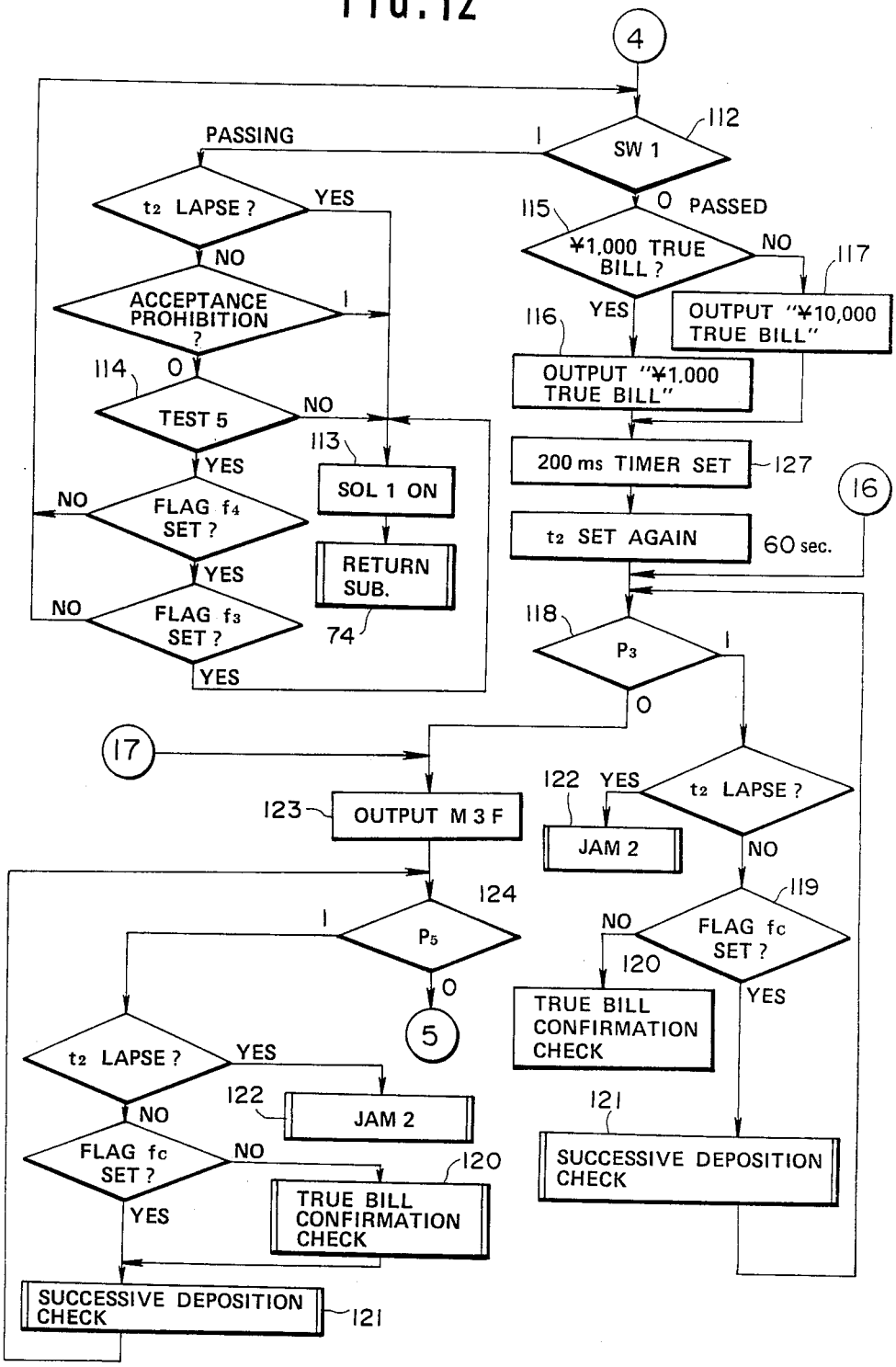

Upon reaching of the bill to the position of the sensor P3, the flow line "0" in block 118 of FIG. 12 is selected and the motor M3 starts the forward rotation by block 123. In a next block 124, whether or not the bill has reached the position of the sensor P5 is examined and, if it has not, the loop of the flow line "1" in block 124 is repeated in the same manner as described above to execute the true bill confirmation check subroutine 120 or the successive deposition check subroutine 121. Upon detection of a bill by the sensor P5, the step proceeds to block 125 of FIG. 13 through a junction 5 to set the timer t3. During the operation time of this timer t3, the loop of NO in block 126 is repeated to execute the true bill confirmation check subroutine 120 or the successive deposition check subroutine 121.

With reference to FIG. 17, description will be made about the true bill confirmation subroutine 120. In block 128, whether a flag fA is set or not is first examined. The flag fA is initially not set and the step shift to block 129 in which whether or not the operation time of a timer of 200 ms which has been set in block 127 in FIG. 12 has elapsed. If the time of 200 ms has not elapsed yet since the generation of the true bill signal (when the processings of blocks 116 and 117 have been made), whether or not the true bill confirmation signal has been given is examined in block 130. If this signal has not been given yet, the subroutine leads to END and is completed there. If the true bill confirmation signal has been given, whether or not the flag fA has been set is examined again in block 131. If the flag fA has not been set, a timer of 50 ms is set in block 132 and the flag fA is set in block 133. Thereafter, whether or not the operation time of the 50 ms timer has elapsed is examined in block 134 and if the result is NO, the routine leads to END.

In executing this subroutine 120 after once confirming that the true bill confirmation signal has been given, the routine leads to block 134 through block 128 YES and block 131 YES, and whether or not the operation time of a timer of 50 ms has elapsed is examined. When the time of 50 ms has elapsed since initial confirmation of the true bill confirmation signal (i.e., falling of this signal), block 134 becomes YES and the production of the true bill signal for a 1,000-yen bill or a 10,000-yen bill which was started in block 116 or 117 in FIG. 12 is stopped (i.e., falls to "0") by the processing in block 135. Then the flag fA, the 50 ms timer and the 200 ms timer are reset and the flag fc is set in block 136 thereby indicating that the true bill confirmation check has been completed.

If no true bill confirmation signal has been given by the lapse of 200 ms since the start of production of the true bill signal, the step shifts to a routine of YES in block 129. In this routine, a timer of 300 ms and a flag fB are set through NO of block 137. After the flag fB has been set, whether or not the operation time of the 300 ms timer has elapsed is examined in block 138 and, if it has, the production of the true bill is stopped by processings in block 139. Then the flag fB, 200 ms timer and 300 ms timer are reset, a "money return flag" is set (block 140) and the flag fc is set in block 136 indicating the completion of the true bill confirmation check. Thus, if no true bill confirmation signal has been given by the lapse of 200 ms after the start of production of the true bill signal, the true bill signal is cancelled 300 ms thereafter and the "money return flag" is set. In accordance with the setting of the "money return flag", the deposited bill which has been once accepted is returned in a subsequent processing.

In a successive deposition check subroutine 121 shown in FIG. 32, whether or not a next bill has been inserted in the insertion slit 10 is checked by a TEST 4 subroutine 76 (FIG. 21). If a next bill has been successively deposited, the motors M1 and M3 are temporarily stopped and the forward rotation of the motors M1 and M2 are resumed when the bill has been removed from the insertion slit 10.

Figure 13:
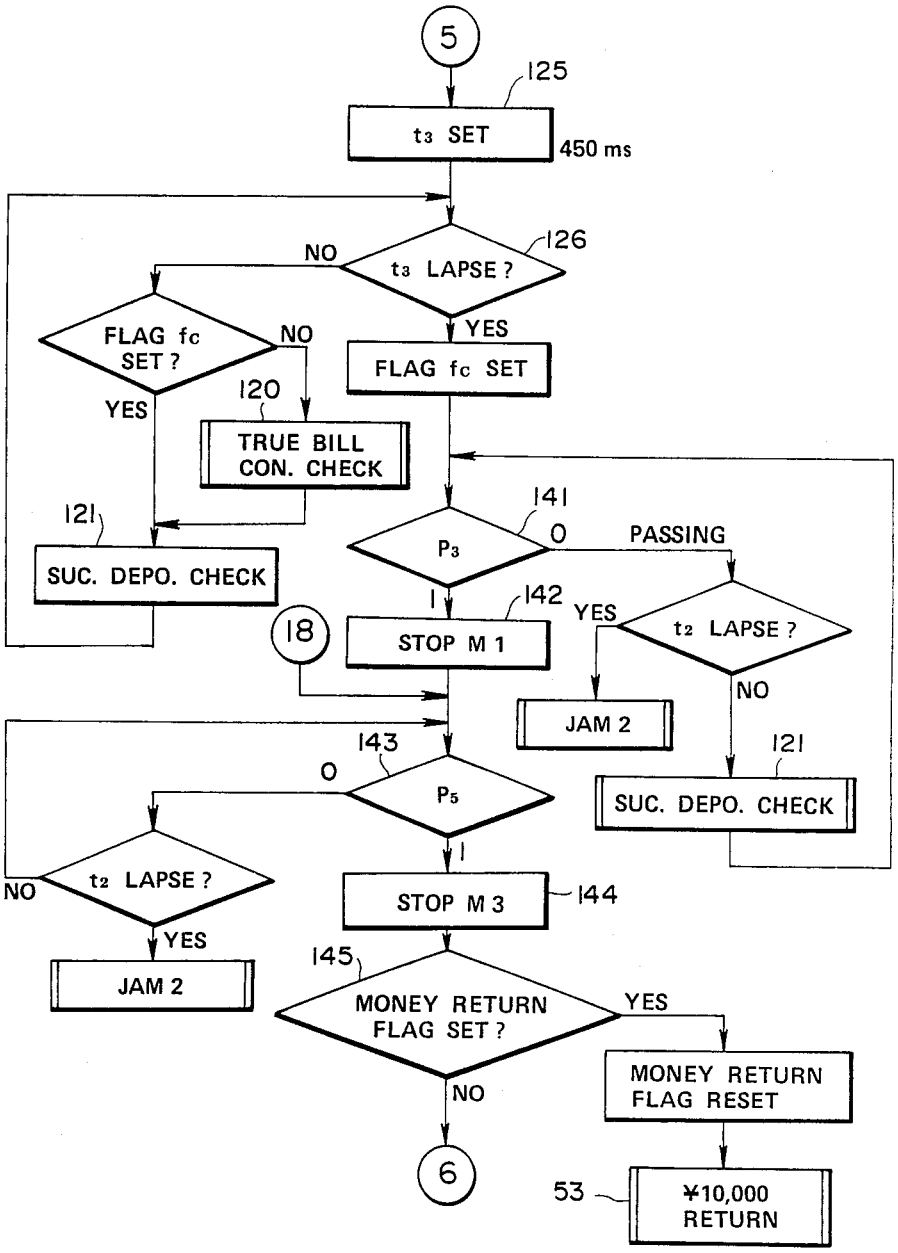

Reverting to FIG. 13, upon confirmation of the lapse of the operation time of the timer t3 in block 126, the flag fc is reset and the output of the sensor P3 is examined in block 141. If the bill is still passing by the sensor P3, the loop of the flow line "0" of block 141 is repeated to execute the successive deposition check subroutine 121. When the rear edge of the bill has passed by the sensor P3, the motor M1 is stopped in block 142 and the output of the sensor P3 is examined in block 143. When the rear edge of the bill has passed by the sensor P5, the motor M3 is stopped in block 144. Thus, the deposited bill which has been judged to be a true bill is stopped in the straight passage portion corresponding to the push plate 14 in the passage 2 of the stacker section 12 and temporarily held there.

In block 145, whether or not the "money return flag" is set is examined. If the result is YES, a "10,000-yen return" subroutine 53 (FIG. 26(*c*)) is executed after resetting the money return flag. If the result is NO, the step proceeds to block 146 in FIG. 14 through a junction 6. In block 146, whether the flag P is set or not is examined. The flag P normally is not set and, accordingly, the routine proceeds from NO in block 146 to block 147 in which whether or not the bill temporarily held in the passage 2 is a 10,000-yen bill is examined. This can be achieved by reading out the storage of judgement in blocks 109 and 110 (FIG. 16) of the head data OK routine 107. If the deposited bill is a 10,000-yen bill, the step returns to START in the main routine (FIG. 4). Accordingly, the deposited 10,000-yen bill which has been judged to be true is held in the passage 2 in a stand-by state. If the deposited bill is a 1,000-yen bill, the step proceeds to block 148 in which the full switch SW2 in the escrow section 13 is checked. If the escrow section 13 is not full, the escrow operation subroutine 88 (FIG. 24) is executed to receive the deposited 1,000-yen bill in the escrow section 13. If the escrow section 13 is full, the flow line "0" of block 148 is selected and the position correction subroutine 50 (FIG. 31) and the stack operation subroutine 51 (FIG. 25) thereby are executed. By these operations, the 1,000-yen bill which has been temporarily stopped in the passage 2 is received in the storing space 12*a* in the stacker section 12.

The 10,000-yen bill which has been held in a stand-by state in the passage 2 is either received in the storing space 12*a* or returned to the insertion slit 10 by execution of the stack operation subroutine 51 or the 10,000-yen return subroutine 53 in response to supply of the "10,000 stack", "10,000 deposited" and "money return" signals when the signal check program 41 (FIG. 7) is executed in the course of repeating the main routine (FIG. 4).

In the escrow operation subroutine 88, the motor M3 is forwardly rotated to feed the 1,000-yen bill in the passage 2 to the escrow section 13 (block 149) as shown in FIG. 24. When the sensor P4 at the entrance of the escrow section 13 has detected the bill, the motor M2 is forwardly rotated (block 150) to wind the bill on the drum 15. When the sensor P4 subsequently has ceased to detect the bill, the flow line "1" of block 151 is selected and the motors M3 and M2 are stopped. If a predetermined output has not been obtained from the sensor P4 within the operation time of the timer t2, a JAM3 subroutine 152 (FIG. 33) is executed to stop the motors M2 and M3. An output connecting point 7 in FIG. 24 is connected to block 153 in FIG. 25. In block 153, whether the timer t1 is to be set or not is determined from the state of the flag f4 and thereafter the timer t2 is reset (block 154).

In the position correction subroutine 50 which is executed prior to the stack operation, the motor M3 is reversely rotated during 300 ms as shown in FIG. 31 to feed the bill once in a direction reverse to the arrow C (blocks 155, 156 and 157). Then the motor M3 is forwardly rotated (block 158) and it is stopped when the rear edge of the bill has passed by the sensor P5 (block 159) and the step proceeds to the stack operation subroutine 51. If this has not been executed smoothly within one second which is the operation time of the timer t5, the step returns to START after executing operations including a JAM3 subroutine 152.

In the stack operation subroutine 51, the timer t2 of 3 seconds is set (block 160) as shown in FIG. 25 to rotate the motor M4 forwardly (block 161). In block 162, whether or not the carrier switch SW6 has been turned ON is examined and, if the switch SW6 has not been turned ON within 3 seconds, a JAM4 subroutine 163 (FIG. 33) is executed to stop the motor M4 and revert the step to START. Upon the lapse of 100 ms from the turning ON of the carrier switch SW6, the state of the switch SW6 is checked again (block 164) and JAM4 is executed also if the switch SW6 has not been turned OFF within the operation time of the timer t2. Thus, the carrier switch SW6 is normally turned ON and OFF within 3 seconds from the start of forward rotation of the motor M4. By turning OFF of the carrier switch SW6, the motor M4 is stopped (block 165). The step then proceeds to block 153 and returns to START. In the above described manner, the rotation of the motor M4 by a predetermined angle controlled by the carrier switch SW6 causes the push plate 14 to reciprocate in the direction of arrow D and thereby causes the bill temporarily held in the passage 2 to be received in the storing space 12*a*.

Figure 34:
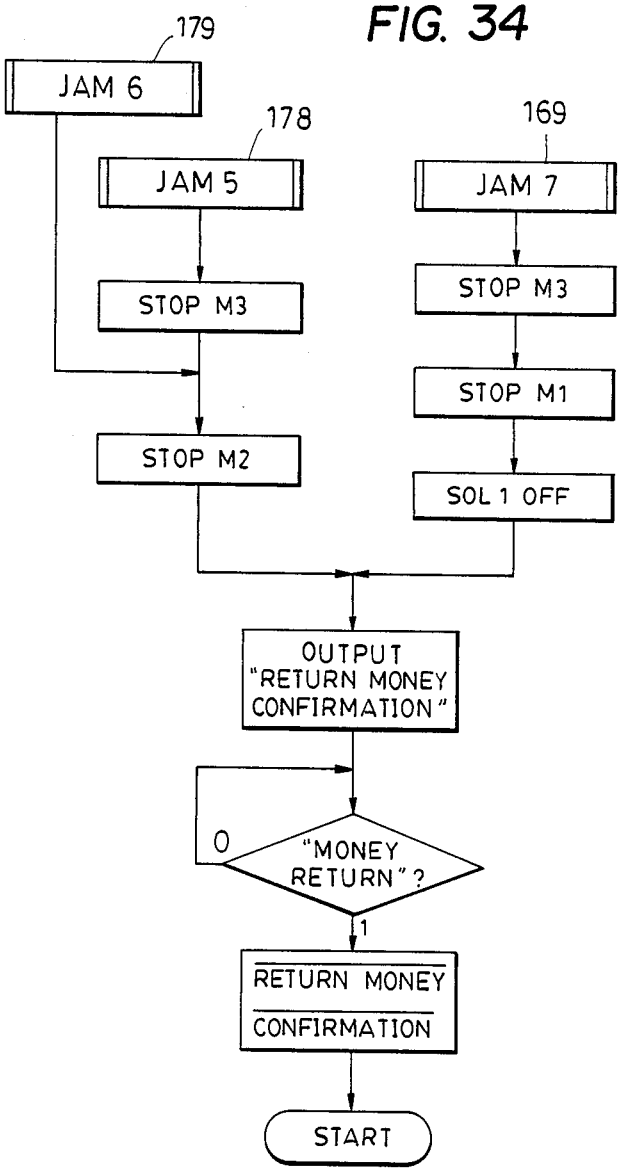

The "10,000-yen return" subroutine 53 starts from block 166 of FIG. 26(*c*). In this subroutine, the timer t4 of 5 seconds is set (started). The motor M3 then is rotated reversely to check the sensors P5 and P3 in blocks 167 and 168. If the sensors P5 and P3 have not detected the bill within the operation time of the timer t4, this is an abnormal state and a JAM7 subroutine 169 (FIG. 34) is executed and the step returns to START. If the 1,000-yen bill or 10,000-yen bill which has been temporarily held in the passage 2 is fed back through the passage 2 in a normal way, the sensors P5 and P3 sequentially detect the bill and the reverse rotation of the motor M1 is started in block 170. Thus, the bill is further fed back through the passage 1. Upon detection of the bill by the sensor P2, a SOL1ON signal is produced in block 171 and the gate lever 6 is withdrawn from the passage 1 to permit the bill to be fed back. The step proceeds to block 172 in FIG. 26(*d*) through a junction 11. When the sensors P5, P3 and P2 have sequentially ceased to detect the bill, stopping of the motor M3 and deenergizing of the solenoid SOL1 are sequentially performed and the step proceeds to block 173 of FIG. 26(*e*) through a junction 12. Upon the lapse of 300 ms since the sensor PL has ceased to detect the bill, the motor M1 is stopped (block 174) and the "return money confirmation" signal is produced (block 175). Responsive to the return money confirmation signal, the control circuit 22 of the vending machine 21 cancels the money return signal. In block 176, the cancellation of the money return signal is confirmed and thereupon the return money confirmation is cancelled (block 177). When the sensors P1R and P1L have ceased to detect the bill, i.e., when the bill which has been automatically fed back to the insertion slit 10 has been removed, the step returns to START. As shown in FIG. 34, the return money confirmation signal is produced also in subroutines 169, 178 and 179 of JAM7, JAM5 and JAM6.

Figure 23:
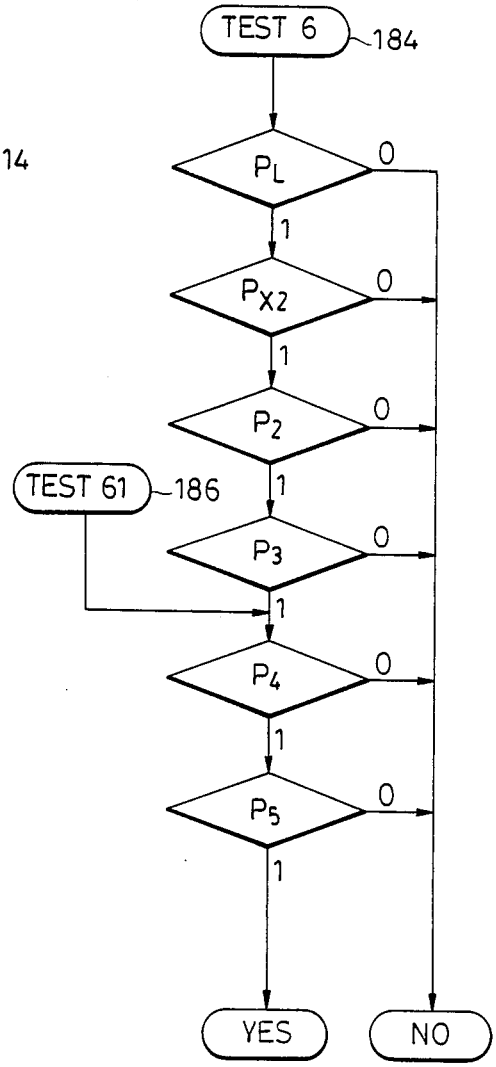

The "10,000-yen return" subroutine 54 starts from block 180 in FIG. 26(*a*) and proceeds to block 181 in FIG. 26(*b*) and further proceeds to block 182 in FIG. 26(*c*) through a junction 10. In block 183, the motor M2 is stopped and the subroutine merges with the "10,000-yen subroutine" 53. In the routine including FIGS. 26(*a*), 26(*b*) and up to block 183 in FIG. 26(*c*), the motors M2 and M3 are rotated reversely to pay out one 1,000-yen bill from the escrow section 13 and stop it immediately before the sensor P5 in the passage 2. Subsequent processings are made in the same manner as the above described subroutine 53 and one bill which has been paid out of the escrow section 13 is finally fed back automatically to the insertion slit 10. Details of TEST 6 routine 184 are illustrated in FIG. 23. A junction 8 of FIGS. 26(*a*) and 26(*b*) is connected to block 185 in FIG. 29.

Figure 28A:
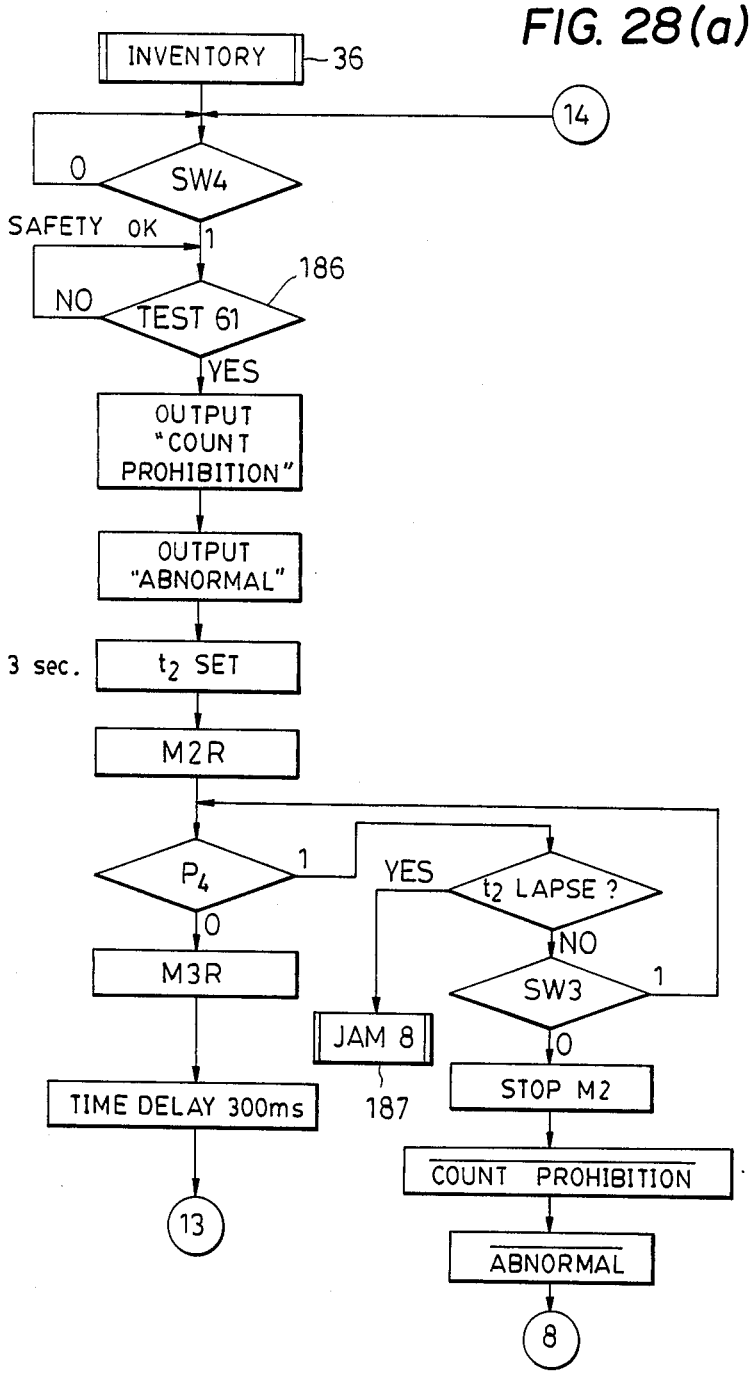
Figure 28B:
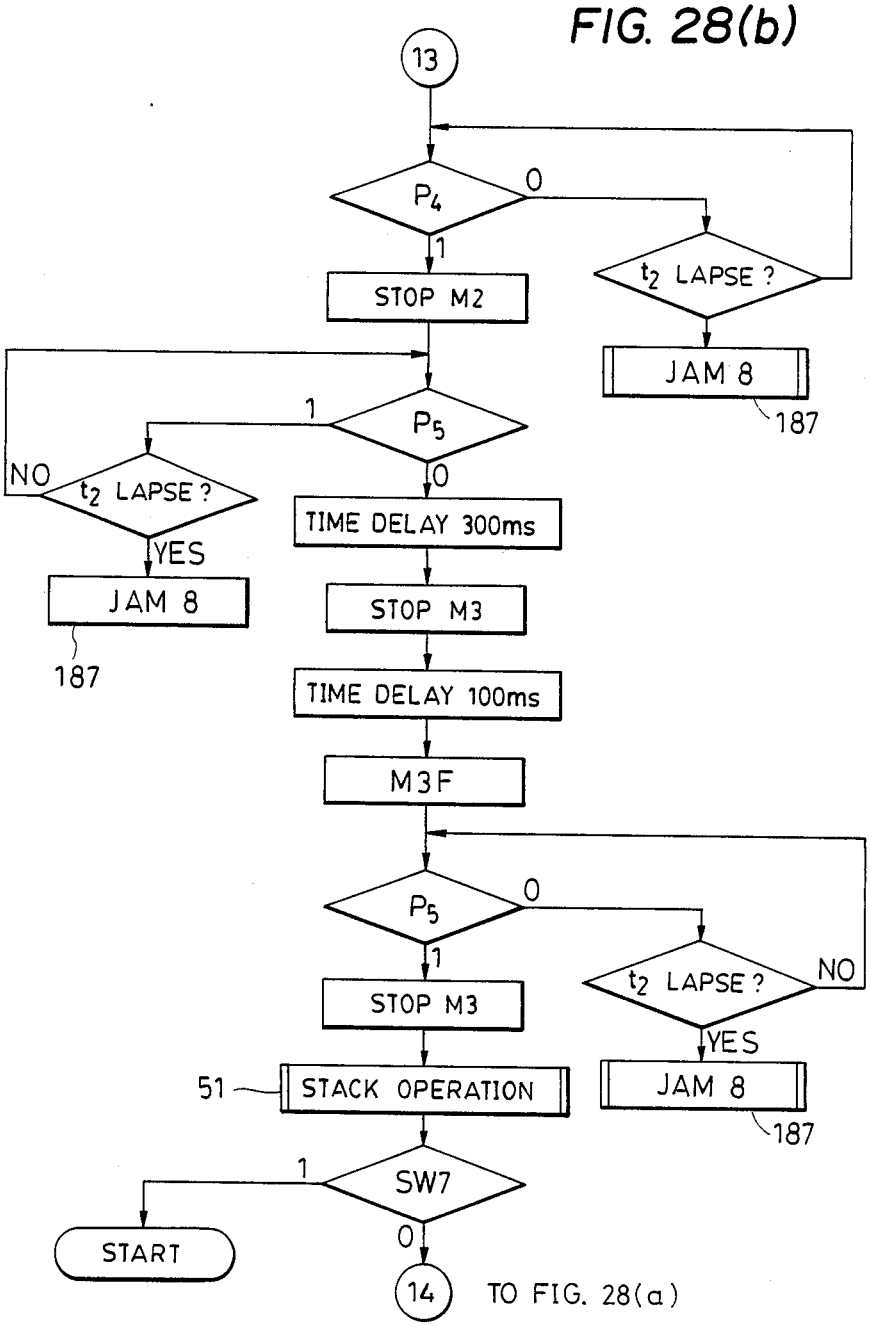

FIGS. 28(*a*) and 28(*b*) show details of an inventory subroutine 36. Details of processings in respective blocks thereof will be apparent from descriptions in these blocks in view of the foregoing explanation. In sum, the motors M2 and M3 are rotated reversely to take out a single bill from the escrow section and convey it to the passage 2 and thereafter the stack operation subroutine 51 is executed to receive the bill in the storing space 12*a*. This routine is repeated until the stacker section 12 becomes full. Details of TEST 61 routine 186 in FIG. 28(*a*) are illustrated in FIG. 23 and details of JAM8 subroutine 187 are illustrated in FIG. 33.

Figure 29:
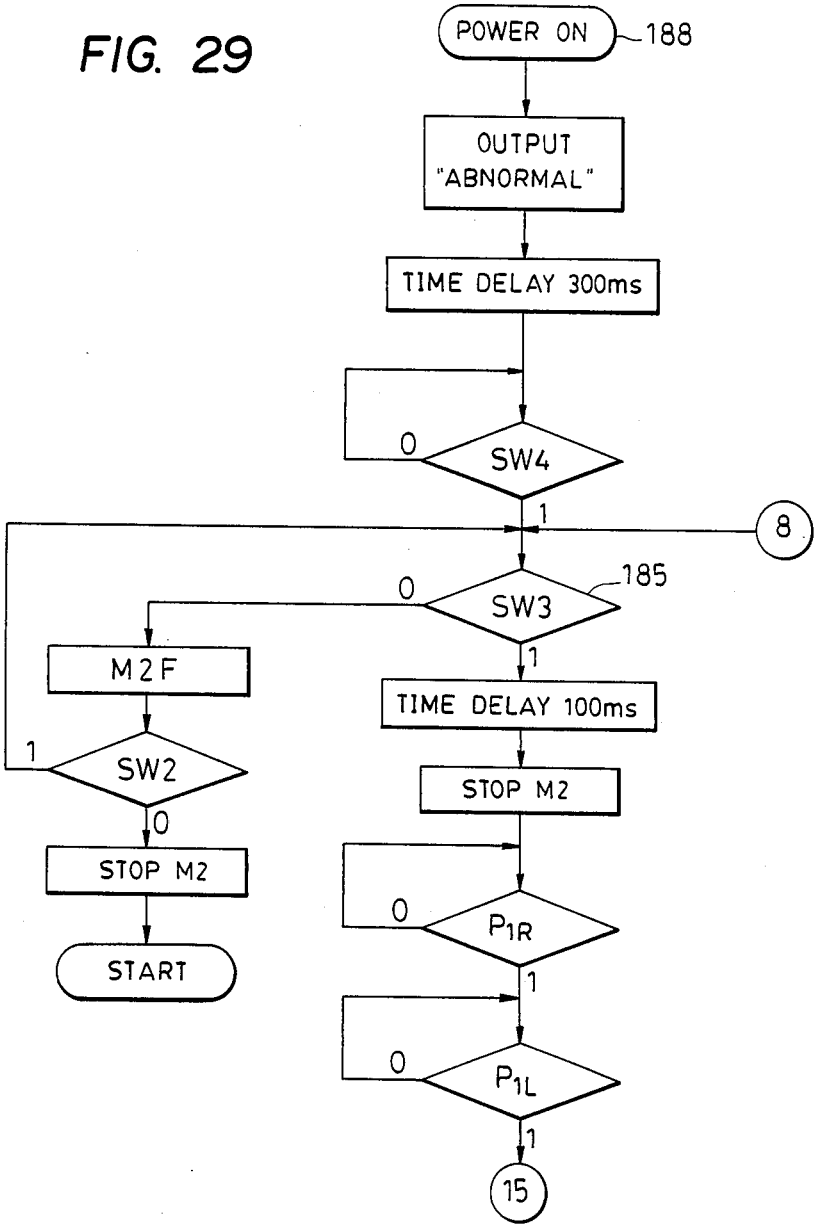
Figure 30:
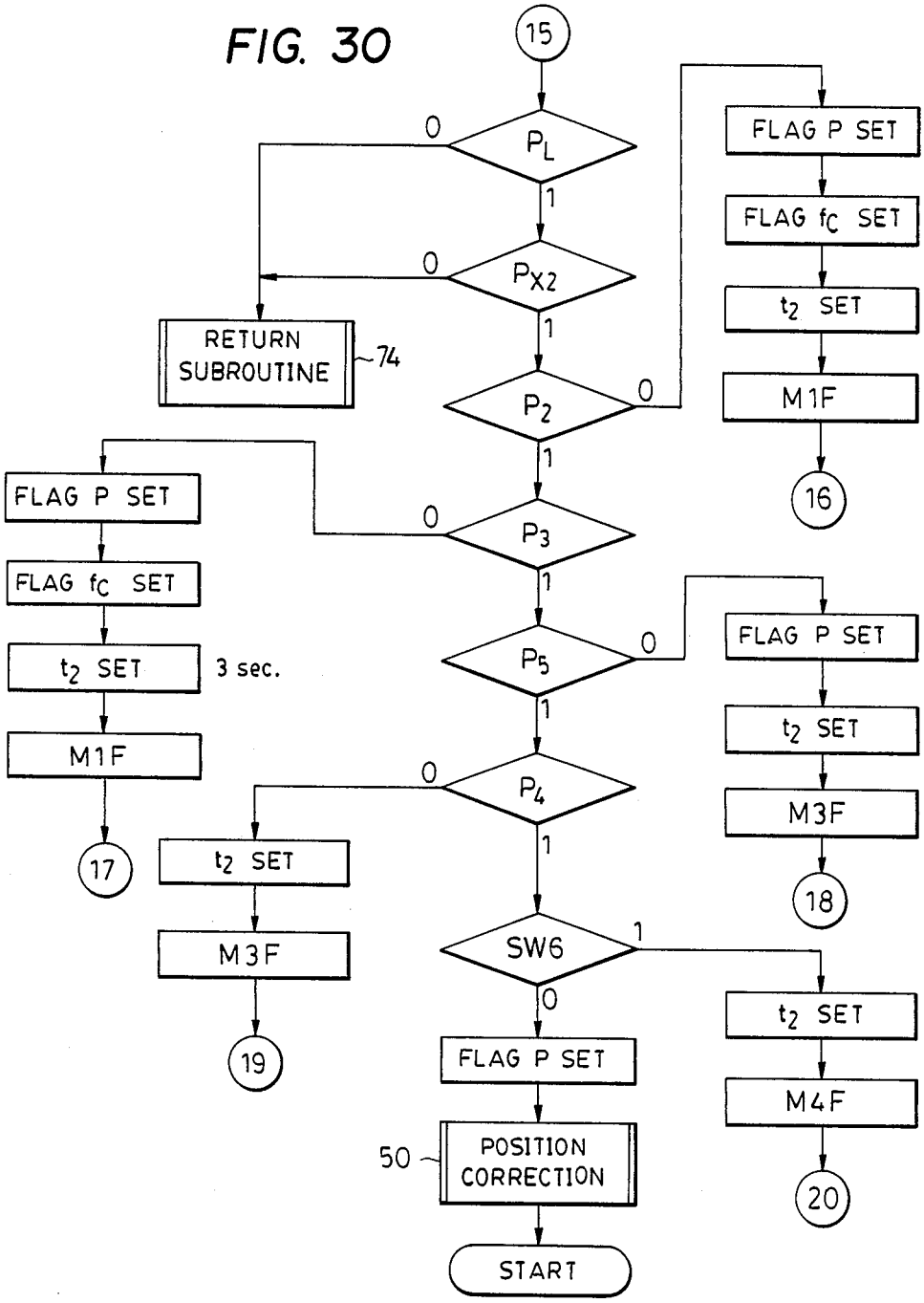

In FIGS. 29 and 30, a routine 188 which is executed when the power switch is ON is illustrated. Meanings of the respective blocks therein will be apparent from the descriptions in these blocks. After power is turned on, the step proceeds to START of the main routine (FIG. 4) through this routine 188.

In the utilizing device such as a vending machine, the true bill signal may be utilized not only for counting deposited bills but for other purposes. In that case, the true bill confirmation signal functions as a signal which confirms that the object utilization has been made, and may thus be designated a "true bill utilization confirmation" signal.

The above description has been made with respect to a case where the currency used in the vending machine is Yen. It will be apparent that other currencies such as dollar and pound can be similarly used in the device.

What is claimed is:

1. A bill acceptance control method comprising:

a first step for judging whether a deposited bill is a true bill or not, and if true, for producing a true bill signal indicating that the deposited bill has been judged to be true;

a second step for utilizing said true bill signal to count the deposited bill when the deposited bill has been judged to be true in said first step to thereby accumulate a count of plural bills judged to be true;

a third step for confirming that the accumulated count has been made in said second step; and a fourth step for accepting the deposited bill if the confirmation has been made in said third step and returning the deposited bill automatically if the confirmation has not been made.

2. A bill acceptance control method as defined in claim 1 wherein, in said fourth step, the deposited bill is accepted if the confirmation in said third step has been made within a predetermined period of time from the time when the deposited bill was judged to be true in said first step whereas the deposited bill is returned automatically if the confirmation has not been made within this predetermined period of time.

3. A bill acceptance control method as defined in claim 1 wherein said second step is performed in a credit counter.

4. A bill acceptance control method as defined in claim 1 wherein said second step of counting is performed in a counter of a vending machine control circuit, said counting indicating vend credit for deposited bills.

* * * * *